US011262119B2

(12) United States Patent
Adachi

(10) Patent No.: US 11,262,119 B2
(45) Date of Patent: Mar. 1, 2022

(54) MOUNTING STRUCTURE AND MOUNTING METHOD OF CRYOCOOLER

(71) Applicant: SUMITOMO HEAVY INDUSTRIES, LTD., Tokyo (JP)

(72) Inventor: Shuntaro Adachi, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 139 days.

(21) Appl. No.: 16/845,087

(22) Filed: Apr. 10, 2020

(65) Prior Publication Data

US 2020/0240702 A1 Jul. 30, 2020

Related U.S. Application Data

(63) Continuation of application No. PCT/JP2018/037606, filed on Oct. 9, 2018.

(30) Foreign Application Priority Data

Oct. 12, 2017 (JP) ..... JP2017-198369

(51) Int. Cl.
*F25B 9/14* (2006.01)
*F25D 23/00* (2006.01)

(52) U.S. Cl.
CPC ..... *F25D 23/006* (2013.01); *F25B 9/14* (2013.01); *F25D 2700/121* (2013.01)

(58) Field of Classification Search
CPC .... F25B 2309/1414; F25B 49/00; F25B 9/14; F25B 9/145; F25D 19/00; F25D 23/006; F25D 2700/121
See application file for complete search history.

(56) References Cited

U.S. PATENT DOCUMENTS 7,310,954 B2 12/2007 Miki
7,600,385 B2 * 10/2009 Yan ..... F25B 9/145 62/6
9,316,418 B2 * 4/2016 Tajima ..... F25B 9/14
(Continued)

FOREIGN PATENT DOCUMENTS

JP H024172 A 1/1990
JP H09287838 A 11/1997
(Continued)

*Primary Examiner* — Filip Zec
(74) *Attorney, Agent, or Firm* — HEA Law PLLC

(57) ABSTRACT

There is provided a mounting structure for mounting a cryocooler cold head on a vacuum vessel. The cold head includes a cold head-side cooling stage and a cold head-side flange. The mounting structure includes a cold head accommodation sleeve installed in the vacuum vessel and including a sleeve-side cooling stage which comes into thermal contact with the cold head-side cooling stage by coming into physical contact with the cold head-side cooling stage, and a sleeve-side flange to be coupled to the cold head-side flange, an inter-flange distance adjustment mechanism configured to adjust a distance between the sleeve-side flange and the cold head-side flange so that the cold head-side cooling stage and the sleeve-side cooling stage are physically brought into contact with each other or brought into a contactless state therebetween, and a flange fastening mechanism configured to fasten the cold head-side flange to the sleeve-side flange.

8 Claims, 11 Drawing Sheets

(56) References Cited

U.S. PATENT DOCUMENTS

| | | | | |
|---|---|---|---|---|
| 9,410,725 | B2 | 8/2016 | Mitsubori | |
| 9,709,313 | B2 * | 7/2017 | Miki | F25D 3/10 |

FOREIGN PATENT DOCUMENTS

| | | | |
|---|---|---|---|
| JP | 2001230459 | A | 8/2001 |
| JP | 2004053068 | A | 2/2004 |
| JP | 3524460 | B2 | 5/2004 |
| JP | 2004294041 | A | 10/2004 |
| JP | 2005210015 | A | 8/2005 |
| JP | 3992276 | B2 | 10/2007 |
| JP | 2013160393 | A | 8/2013 |

* cited by examiner

10

10

MOUNTING STRUCTURE AND MOUNTING METHOD OF CRYOCOOLER

RELATED APPLICATIONS

Priority is claimed to Japanese Patent Application No. 2017-198369, filed Oct. 12, 2017, and International Patent Application No. PCT/JP2018/037606, the entire content of each of which is incorporated herein by reference.

BACKGROUND

Technical Field

Certain embodiments of the present invention relate to a mounting structure and a mounting method of a cryocooler to be mounted on a vacuum vessel.

Description of Related Art

In the related art, a technique is known in which a cold head of a cryocooler is mounted on a cryogenic vacuum vessel such as a cryostat via a sleeve. For example, a cooling target such as a superconducting coil is accommodated inside the cryogenic vacuum vessel, and the cooling target is attached to an end of the sleeve so that the cold head and the sleeve are brought into thermal contact with each other. The thermal contact between the cold head and the sleeve enables the cryocooler to cool the cooling target via the sleeve.

When the cryocooler is operated on a long-term basis, maintenance work needs to be regularly carried out for the cryocooler. An operator operates amounting structure using the sleeve, and releases the thermal contact between the cold head and the sleeve. In this manner, the operator can carry out the maintenance work for the cryocooler. The cryocooler is heated to a temperature suitable for the maintenance work, for example, a room temperature, and is re-cooled after the work is completed. As the thermal contact is released, the cooling target can be kept at a low temperature. Therefore, a re-cooling time of the cooling target can be shortened, compared to a case where the maintenance work is carried out for the cryocooler by heating the cooling target together with the cryocooler to the room temperature, and a time required for the maintenance work can be shortened.

SUMMARY

According to an aspect of embodiments of the invention, there is provided a mounting structure for mounting a cold head of a cryocooler on a vacuum vessel. The cold head includes a cold head-side cooling stage and a cold head-side flange. The mounting structure includes a cold head accommodation sleeve that is installed in the vacuum vessel so as to form an airtight region isolated from an ambient environment between the cold head and the cold head accommodation sleeve, and that includes a sleeve-side cooling stage which comes into thermal contact with the cold head-side cooling stage by coming into physical contact with the cold head-side cooling stage, and a sleeve-side flange to be coupled to the cold head-side flange, an inter-flange distance adjustment mechanism configured to adjust a distance between the sleeve-side flange and the cold head-side flange so that the cold head-side cooling stage and the sleeve-side cooling stage are physically brought into contact with each other or brought into a contactless state therebetween, while maintaining isolation of the airtight region from the ambient environment, and a flange fastening mechanism configured to fasten the cold head-side flange to the sleeve-side flange so that the cold head-side cooling stage is pressed against the sleeve-side cooling stage with a pressing contact pressure designated to bring the cold head-side cooling stage and the sleeve-side cooling stage into thermal contact with each other under thermal resistance equal to or smaller than a threshold.

According to another aspect of embodiments of the invention, there is provided a mounting method of mounting a cold head of a cryocooler on a vacuum vessel via a cold head accommodation sleeve. The cold head includes a cold head-side cooling stage and a cold head-side flange. The cold head accommodation sleeve includes a sleeve-side cooling stage which comes into thermal contact with the cold head-side cooling stage by coming into physical contact with the cold head-side cooling stage, and a sleeve-side flange to be coupled to the cold head-side flange. The cold head accommodation sleeve is installed in the vacuum vessel so as to form an airtight region isolated from an ambient environment between the cold head and the cold head accommodation sleeve. The mounting method includes holding isolation of the airtight region from the ambient environment, adjusting a distance between the sleeve-side flange and the cold head-side flange so that the cold head-side cooling stage and the sleeve-side cooling stage are physically brought into contact with each other, and fastening the cold head-side flange to the sleeve-side flange so that the cold head-side cooling stage is pressed against the sleeve-side cooling stage with a pressing contact pressure designated to bring the cold head-side cooling stage and the sleeve-side cooling stage into thermal contact with each other under thermal resistance equal to or smaller than a threshold.

DETAILED DESCRIPTION

Figure 1:
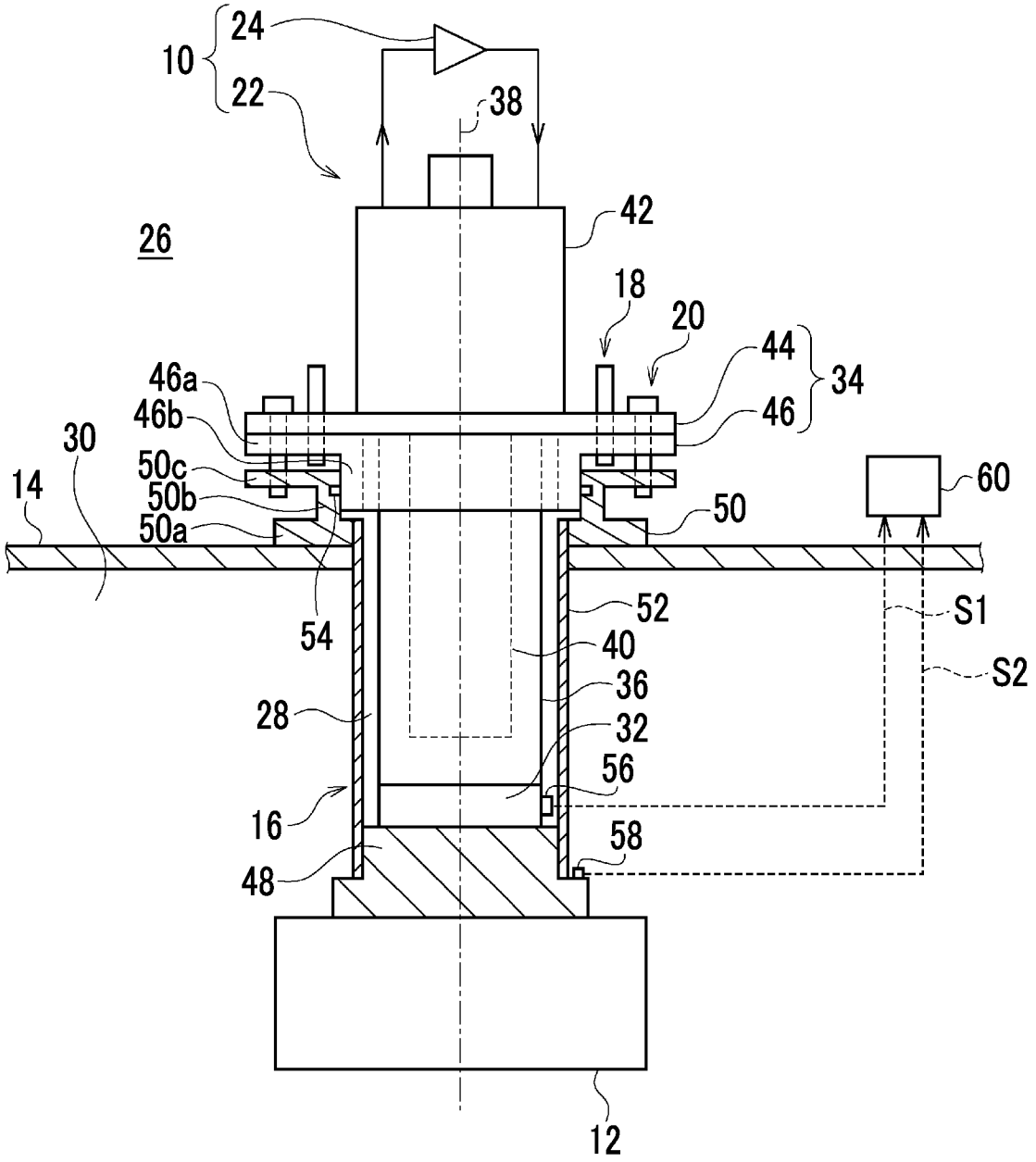
FIG. 1 is a schematic view for describing a mounting structure according to an embodiment.

As a result of intensive studies on a mounting structure of a cryocooler to be mounted on a vacuum vessel via a sleeve, the present inventor has come to recognize the following problems. The present inventor has found out a new phenomenon as follows. A thermal contact state between the cryocooler and the sleeve is likely to deteriorate when maintenance work is repeatedly carried out several times for the cryocooler mounted by this type of the mounting structure. Usually, a portion in which the cryocooler and the sleeve are in thermal contact with each other has an indium sheet interposed therebetween in order to improve the thermal contact. According to the studies of the present inventor, it is conceivable that the phenomenon where the thermal contact state deteriorates is caused by interposition of the indium sheet. The deteriorated thermal contact may undesirably lead to an increase in a cooling temperature of a cooling target or a decrease in cooling efficiency.

It is desirable to provide a technique for allowing a cryocooler mounted on a vacuum vessel via a sleeve to satisfactorily maintain thermal contact between the cryocooler and the sleeve on a long-term basis, even if maintenance work is repeatedly carried out for the cryocooler.

Any desired combinations of the above-described configuration elements or those in which the configuration elements and expressions according to the embodiments of the invention are substituted with each other in methods, devices, and systems are also effective as the aspect according to the embodiments of the invention.

According to the embodiments of the invention, a cryocooler mounted on a vacuum vessel via a sleeve can satisfactorily maintain thermal contact between the cryocooler and the sleeve on a long-term basis, even if maintenance work is repeatedly carried out for the cryocooler.

Hereinafter, embodiments according to the invention will be described in detail with reference to the drawings. In the description and the drawings, the same reference numerals will be given to the same or equivalent configuration elements, members, and processes, and repeated description will be appropriately omitted. Scales or shapes of respectively illustrated units or portions are set for the sake of convenience in order to facilitate understanding of the description, and are not to be interpreted in a limited way unless otherwise specified. The embodiments are merely examples, and do not limit the scope of the embodiments of the invention at all. All features and combinations thereof which are described in the embodiments are not necessarily essential to the invention.

Figure 2:
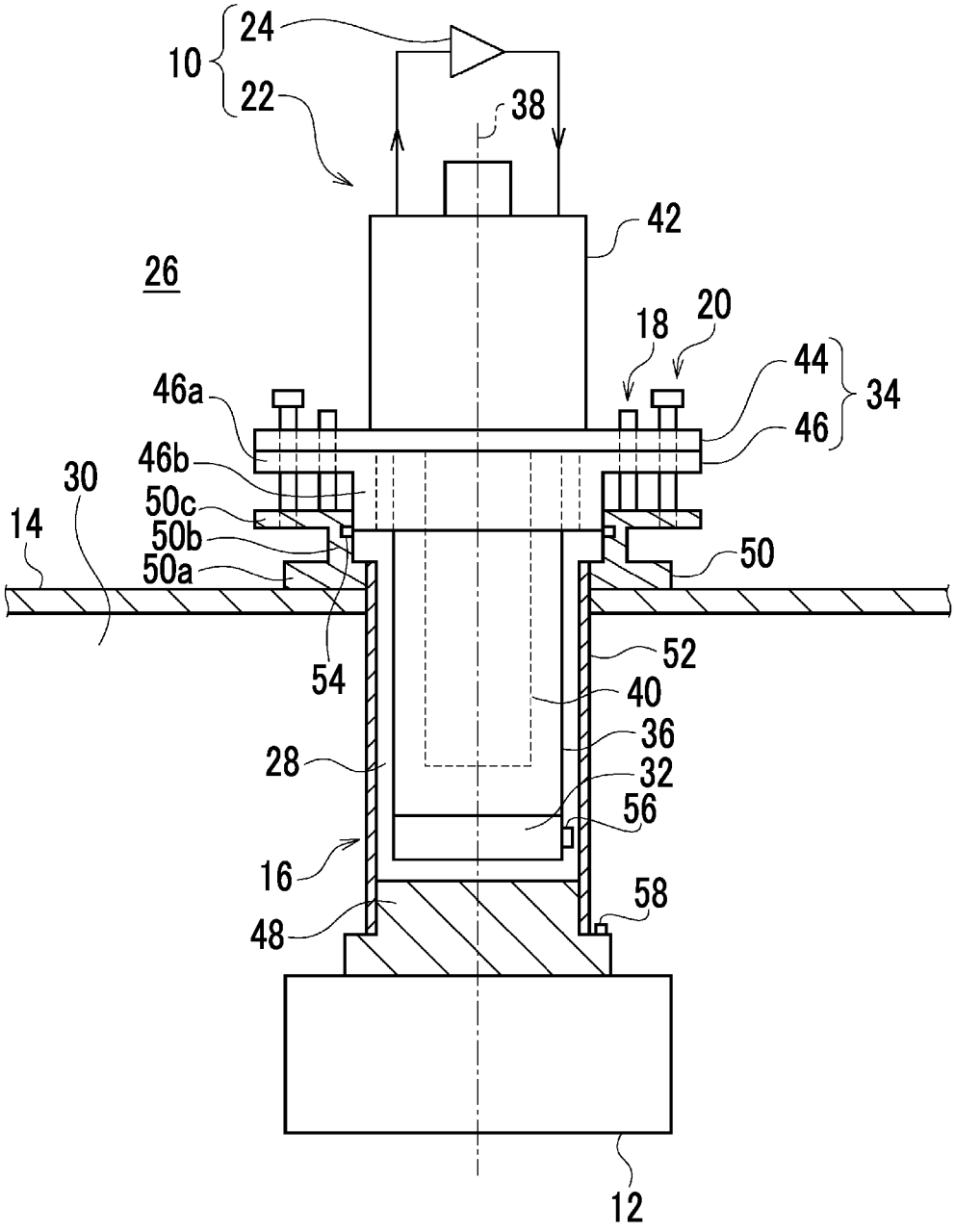
FIG. 2 is a schematic view for describing the mounting structure according to the embodiment.

FIGS. 1 and 2 are schematic views for describing a mounting structure according to an embodiment. FIG. 1 illustrates a state where a cryocooler 10 thermally coupled to a cooling target 12, for example, such as a superconducting coil. FIG. 2 illustrates a state where both of these are thermally uncoupled from each other.

The mounting structure according to the embodiment is an apparatus for mounting the cryocooler 10 on a vacuum vessel 14, for example, a cryogenic vessel such as a cryostat. The mounting structure includes a cold head accommodation sleeve (hereinafter, simply referred to as a sleeve) 16, an inter-flange distance adjustment mechanism 18, and a flange fastening mechanism 20. The cryocooler 10 includes a cold head 22 and a compressor 24.

The sleeve 16 is installed in the vacuum vessel 14 so as to form an airtight region 28 isolated from an ambient environment 26 between the cold head 22 and the sleeve 16. For example, the ambient environment 26 is an atmospheric pressure environment having a room temperature. The airtight region 28 may be evacuated to a vacuum state, or may be filled with cryogenic and non-liquefiable inert gas such as helium gas.

In addition, the sleeve 16 is installed in the vacuum vessel 14 so as to define a vacuum region 30 inside the vacuum vessel 14 in combination with the vacuum vessel 14. As an example, an upper end portion of the sleeve 16 is attached to an opening portion formed in a top plate of the vacuum vessel 14, and the sleeve 16 extends into the vacuum vessel 14 from the opening portion. A lower end of the sleeve 16 is attached to the cooling target 12 directly or via any desired heat transfer member. The cooling target 12 is located in the vacuum region 30.

As an example, the cryocooler 10 is a single-stage Gifford McMahon cryocooler (hereinafter, also referred to as a GM cryocooler). Accordingly, the mounting structure is configured so that the single-stage GM cryocooler is attached to the vacuum vessel 14. However, without being limited thereto, the cryocooler 10 may be a two-stage GM cryocooler. In this case, the mounting structure may be configured so that the two-stage GM cryocooler can be attached to the vacuum vessel 14. The cryocooler 10 may be other cryocoolers such as a Stirling cryocooler and a pulse tube cryocooler.

The cryocooler 10 may be provided for a customer by a manufacturer of the cryocooler 10 together with the above-described mounting structure. A cooling system for cooling the cooling target 12 is configured to include the cryocooler 10 and the mounting structure. Therefore, the cooling system according to the embodiment includes the cryocooler 10, the sleeve 16, the inter-flange distance adjustment mechanism 18, and the flange fastening mechanism 20.

The cold head 22 of the cryocooler 10 includes a cold head-side cooling stage 32, a cold head-side flange 34, and a cylinder 36. The cylinder 36 extends along a central axis 38, and links the cold head-side flange 34 with the cold head-side cooling stage 32. The cold head-side flange 34 and the cold head-side cooling stage 32 are arranged coaxially with the cylinder 36. The cold head-side flange 34 is disposed in an upper end of the cylinder 36, and the cold head-side cooling stage 32 is disposed in a lower end of the cylinder 36.

As an example, the cylinder 36 is a hollow cylindrical member, and the cold head-side flange 34 is an annular member spreading outward in a radial direction perpendicular to the central axis 38 from a peripheral edge of an upper end opening of the cylinder 36. The cold head-side cooling stage 32 is a disk-shaped or short cylindrical member fixedly attached to the cylinder 36 so as to close a lower end opening of the cylinder 36. For example, the cold head-side cooling stage 32 is formed of a highly heat conductive metal such as copper (for example, pure copper) or other heat conductive materials. For example, the cold head-side flange 34 and the cylinder 36 are formed of metal such as stainless steel. Thermal conductivity of the heat conductive material for forming the cold head-side cooling stage 32 is higher than thermal conductivity of the material for forming the cylinder 36 (or the cold head-side flange 34).

The compressor 24 of the cryocooler 10 is disposed in order to circulate working gas (for example, helium gas) in the cryocooler 10. The compressor 24 is configured to supply the working gas having a high pressure to the cold head 22, to recover the working gas having a low pressure which is decompressed through adiabatic expansion in an expansion space inside the cold head 22 from the cold head 22, and to increase the pressure of the working gas again.

Furthermore, the cold head 22 includes a displacer 40 and a drive unit 42 linked with the displacer 40 so as to drive the displacer 40. The displacer 40 is located coaxially with the cylinder 36 inside the cylinder 36, and is capable of reciprocating along the cylinder 36 in a direction of the central axis 38. The expansion space of the working gas is formed between the displacer 40 and the cold head-side cooling stage 32. In addition, a valve for controlling the pressure of the expansion space is incorporated in the drive unit 42. The pressure control valve is configured to alternately switch between supplying high pressure working gas supply from the compressor 24 to the expansion space and recovering the low pressure working gas from the expansion space to the compressor 24. The drive unit 42 is configured to properly synchronize a volume change in the expansion space which is caused by axial reciprocating motion of the displacer 40 with a pressure change in the expansion space which is caused by the pressure control valve. In this manner, the cold head 22 can cool the cold head-side cooling stage 32.

For example, the drive unit 42 is fixed to the cold head-side flange 34 by using a fastening member (not illustrated) such as a bolt. The drive unit 42 is unfastened, thereby enabling the drive unit 42 to be detached from the cold head 22 integrally with the displacer 40.

The cold head-side flange 34 is a coupling body of two flanges. That is, the cold head-side flange 34 includes a cylinder flange 44 integrally formed with the cylinder 36 in a peripheral edge of the upper end opening of the cylinder 36, and a transition flange 46 attached to a lower surface of the cylinder flange 44. The drive unit 42 is detachably fixed to the cylinder flange 44. When the drive unit 42 is detached therefrom, the displacer 40 is pulled out from the upper end opening of the cylinder 36. When the drive unit 42 is attached thereto, the displacer 40 is inserted into the cylinder 36 from the upper end opening of the cylinder 36.

The transition flange 46 is one of configuration elements of the mounting structure, and includes an annular plate portion 46*a* and a cylinder portion 46*b*. For example, the annular plate portion 46*a* is fixed to a lower surface of the cylinder flange 44 by using a fastening member (not illustrated) such as a bolt. The cylinder portion 46*b* extends downward in the direction of the central axis 38 from the annular plate portion 46*a*. The cylinder portion 46*b* is a short cylinder, and surrounds an upper end of the cylinder 36. A diameter of the cylinder portion 46*b* is slightly larger than a diameter of the cylinder 36, and there is a gap between an inner peripheral surface of the cylinder portion 46*b* and an outer peripheral surface of the cylinder 36 so that both of these do not come into contact with each other.

The compressor 24, the cold head-side flange 34, and the drive unit 42 are arranged in the ambient environment 26.

The sleeve 16 is located coaxially with the cylinder 36 so as to surround the cylinder 36. The sleeve 16 includes a sleeve-side cooling stage 48, a sleeve-side flange 50, and a sleeve body 52.

The sleeve-side cooling stage 48 comes into thermal contact with the cold head-side cooling stage 32 by coming into physical contact with the cold head-side cooling stage 32. As an example, a contact surface between the sleeve-side cooling stage 48 and the cold head-side cooling stage 32 is flat. However, the configuration is not limited to this shape. As will be described later, the cold head-side cooling stage 32 may have a tapered surface, an inclined surface, or a non-flat surface such as an irregular surface. An inner surface of the sleeve-side cooling stage 48 which is exposed to the airtight region 28 may be a non-flat surface corresponding to this non-flat surface. The cooling target 12 is attached to an outer surface of the sleeve-side cooling stage 48 which is exposed to the vacuum region 30.

Therefore, when the cold head-side cooling stage 32 comes into physical contact with the sleeve-side cooling stage 48, the cold head-side cooling stage 32 is thermally coupled with the cooling target 12 via the sleeve-side cooling stage 48. Accordingly, the cooling target 12 can be cooled by cooling the cold head-side cooling stage 32. For example, in a case where the cooling target 12 is a superconducting device such as a superconducting coil, the cryocooler 10 can cryogenically cool the cooling target 12 at a critical or lower temperature of the superconducting material.

For reasons to be described later, it is desirable that the cold head-side cooling stage 32 and the sleeve-side cooling stage 48 are in direct contact with each other without any interposed substance for heat transfer such as an indium sheet. However, the embodiments of the invention do not require the absence of the interposed substance. In a case where the interposed substance is permitted, the cold head-side cooling stage 32 and the sleeve-side cooling stage 48 may be in thermal contact with each other while the interposed substance for heat transfer such as the indium sheet is interposed therebetween.

The sleeve-side flange 50 is coupled with the cold head-side flange 34, and is located in the ambient environment 26. As an example, the sleeve-side flange 50 includes an annular first plate portion 50*a*, a cylinder portion 50*b*, and an annular second plate portion 50*c*. The annular first plate portion 50*a* and the annular second plate portion 50*c* are linked to each other by the cylinder portion 50*b*. The annular first plate portion 50*a* is fixed to the upper surface of the vacuum vessel 14 by using a fastening member (not illustrated) such as a bolt. The cylinder portion 50*b* is a short cylinder, and extends upward in the direction of the central axis 38 from the first plate portion 50*a*. For example, the second plate portion 50*c* faces the annular plate portion 46*a* of the transition flange 46 while a distance of approximately several mm is left therebetween.

The cylinder portion 50*b* of the sleeve-side flange 50 is located immediately adjacent to an outside of the cylinder portion 46*b* of the transition flange 46, and both of these are in contact with each other. A seal member 54 for maintaining airtightness of the airtight region 28 is located between the cylinder portion 50*b* of the sleeve-side flange 50 and the cylinder portion 46*b* of the transition flange 46. For example, the seal member 54 is an O-ring located in a circumferential groove formed in the cylinder portion 50*b* of the sleeve-side flange 50.

The sleeve body 52 is a hollow cylindrical member, extends coaxially with the cylinder 36 along the central axis 38, and links the sleeve-side flange 50 to the sleeve-side cooling stage 48. The sleeve-side flange 50 is disposed in an upper end of the sleeve body 52, and the sleeve-side cooling stage 48 is disposed in a lower end of the sleeve body 52. The sleeve-side flange 50 is an annular member spreading outward in the radial direction perpendicular to the central axis 38 from a peripheral edge of an upper end opening of the sleeve body 52. The sleeve-side cooling stage 48 is a disk-shaped or short cylindrical member fixedly attached to the sleeve body 52 so as to close a lower end opening of the sleeve body 52.

For example, the sleeve-side cooling stage 48 is formed of a highly heat conductive metal such as copper (for example, pure copper) or other heat conductive materials. For example, the sleeve-side flange 50 and the sleeve body 52 are formed of metal such as stainless steel. The thermal conductivity of the heat conductive material for forming the sleeve-side cooling stage 48 is higher than the thermal conductivity of the material for forming the sleeve body 52 (or the sleeve-side flange 50).

The cold head-side flange 34 is slidable to and from the sleeve-side flange 50 in an axial direction. In this manner, the cold head 22 is moveable to and from the sleeve 16 in the axial direction. A movable range is approximately several mm, for example, approximately 2 to 3 mm. Since the seal member 54 is provided, even if the cold head 22 moves, the airtight region 28 is isolated from the ambient environment 26.

FIG. 1 illustrates a state where the cold head 22 is located in a lower end of the movable range, and the cold head-side cooling stage 32 and the sleeve-side cooling stage 48 are in thermal contact with each other. FIG. 2 illustrates a state where the cold head 22 is located in an upper end of the movable range, and the cold head-side cooling stage 32 is separated from the sleeve-side cooling stage 48 so that the thermal contact is released therebetween.

The flange distance adjustment mechanism 18 is configured to adjust a distance between the sleeve-side flange 50 and the cold head-side flange 34 so that the cold head-side cooling stage 32 and the sleeve-side cooling stage 48 are physically brought into contact with each other or brought into a contactless state therebetween, while maintaining isolation of the airtight region 28 from the ambient environment 26. An operator operates the inter-flange distance adjustment mechanism 18, thereby enabling the cold head 22 to be raised and lowered in the above-described movable range. An exemplary configuration of the inter-flange distance adjustment mechanism 18 will be described later.

The flange fastening mechanism 20 is configured to fasten the cold head-side flange 34 to the sleeve-side flange 50 so that the cold head-side cooling stage 32 is pressed against the sleeve-side cooling stage 48. The flange fastening mechanism 20 presses the cold head-side cooling stage 32 against the sleeve-side cooling stage 48 with a pressing contact pressure designated to bring the cold head-side cooling stage 32 and the sleeve-side cooling stage 48 into thermal contact with each other under thermal resistance equal to or smaller than a threshold. In the following description, the threshold will be referred to as a thermal resistance threshold. The operator operates the flange fastening mechanism 20, thereby enabling the flange fastening mechanism 20 to adjust the pressing contact pressure acting between the cold head-side cooling stage 32 and the sleeve-side cooling stage 48. An exemplary configuration of the flange fastening mechanism 20 will be described later.

In addition, the cold head 22 includes a cold head-side temperature sensor 56 that measures a temperature of the cold head-side cooling stage 32. The cold head-side temperature sensor 56 is located in the cold head-side cooling stage 32. The sleeve 16 includes a sleeve-side temperature sensor 58 that measures a temperature of the sleeve-side cooling stage 48. The sleeve-side temperature sensor 58 is located in the sleeve-side cooling stage 48. The cold head-side temperature sensor 56 is configured to output a signal S1 indicating a cold head measurement temperature to the outside, and the sleeve-side temperature sensor 58 is configured to output a signal S2 indicating a sleeve measurement temperature to the outside. Therefore, the operator can acquire the measurement temperature of the cold head-side cooling stage 32 and the measurement temperature of the sleeve-side cooling stage 48, and can obtain a temperature difference ΔT therebetween. An output unit 60 may be disposed to display or output the measurement temperature (and/or the temperature difference).

The cold head-side flange 34 and the sleeve-side flange 50 are fastened to each other by the flange fastening mechanism 20 so that the temperature difference ΔT between the measurement temperature of the cold head-side cooling stage 32 and the measurement temperature of the sleeve-side cooling stage 48 falls within a predetermined temperature difference corresponding to the thermal resistance threshold. The operator operates the flange fastening mechanism 20, thereby enabling the cold head-side flange 34 and the sleeve-side flange 50 to be fastened to each other so that the temperature difference ΔT falls within the predetermined temperature difference corresponding to the thermal resistance threshold.

Figure 3:
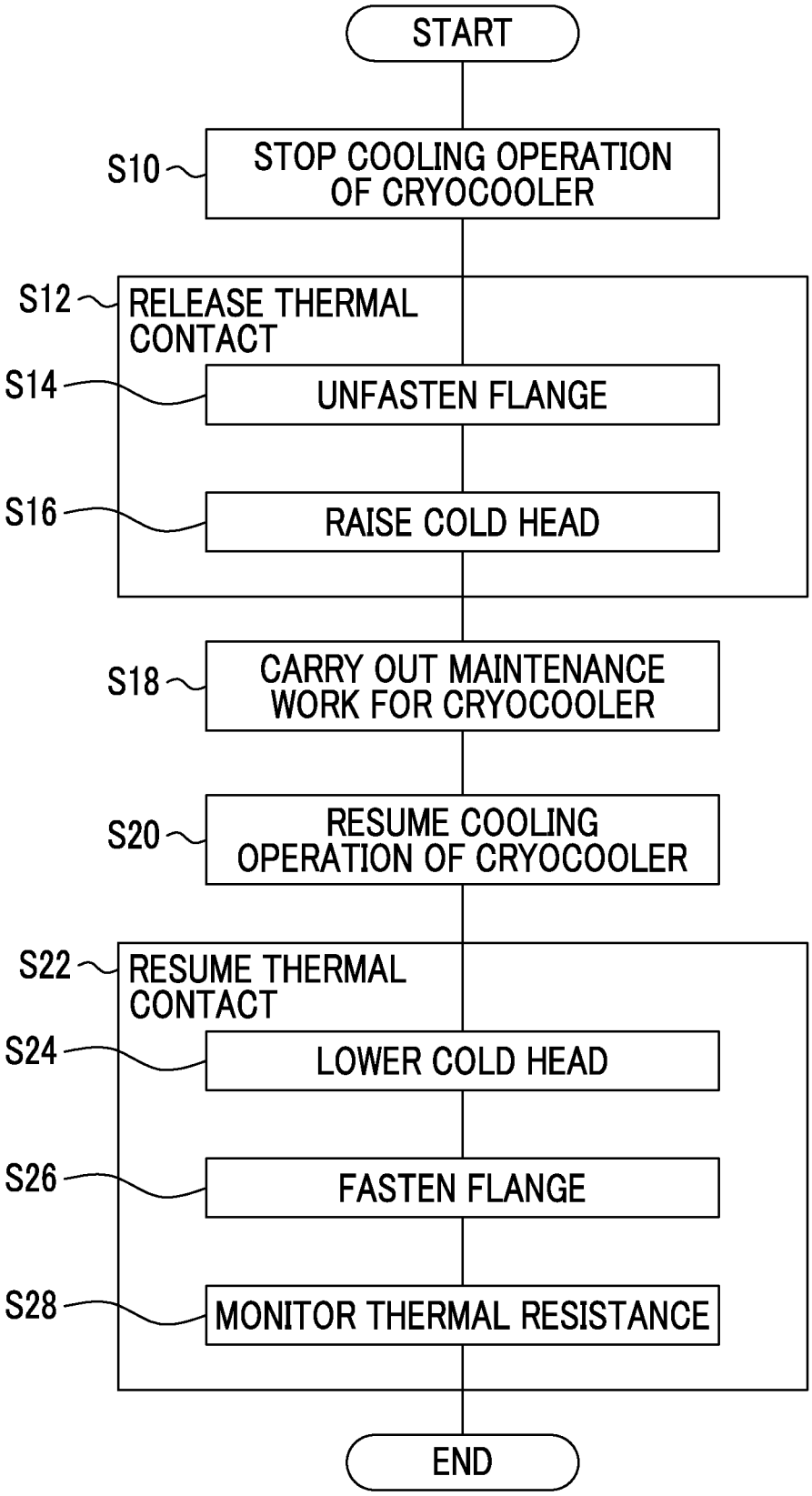
FIG. 3 is a flowchart for describing a mounting method according to the embodiment.

FIG. 3 is a flowchart for describing a mounting method according to the embodiment. At a timing for allowing maintenance work to be carried out for the cryocooler 10, a cooling operation of the cryocooler 10 is stopped (S10).

The operator operates the inter-flange distance adjustment mechanism 18 and the flange fastening mechanism 20, thereby causing the cryocooler 10 and the cooling target 12 to be thermally uncoupled from each other (S12). For that purpose, the cold head-side flange 34 and the sleeve-side flange 50 are first unfastened from each other by the flange fastening mechanism 20 (S14). Next, while the isolation of the airtight region 28 from the ambient environment 26 is maintained, a distance between the sleeve-side flange 50 and the cold head-side flange 34 is adjusted so that the cold head-side cooling stage 32 does not physically come into contact with the sleeve-side cooling stage 48. Since the seal member 54 is disposed between the cold head-side flange 34 and the sleeve-side flange 50, the isolation of the airtight region 28 from the ambient environment 26 is maintained. In this way, the cold head 22 is raised by the inter-flange distance adjustment mechanism 18 (S16). Since the cold head 22 is raised, the cold head-side cooling stage 32 is separated from the sleeve-side cooling stage 48, thereby releasing the thermal contact therebetween. The cold head 22 can be heated while the cooling target 12 is kept at a low temperature.

The maintenance work is carried out for the cryocooler 10 (S18). The drive unit 42 and the displacer 40 are detached from the cold head 22. The cylinder 36 and the cold head-side cooling stage 32 are installed in the sleeve 16 without any change. Then, the drive unit 42 and the displacer 40 for which the maintenance work is completely carried out (or new products) are attached to the cold head 22. Then, the cooling operation of the cryocooler 10 is resumed (S20).

The operator operates the inter-flange distance adjustment mechanism 18 and the flange fastening mechanism 20 again, thereby allowing the cryocooler 10 and the cooling target 12 to be thermally coupled with other again (S22). While the isolation of the airtight region 28 from the ambient environment 26 is maintained, a distance between the sleeve-side flange 50 and the cold head-side flange 34 is adjusted so that the cold head-side cooling stage 32 is physically brought into contact with the sleeve-side cooling stage 48. In this way, the cold head 22 is lowered by the inter-flange distance adjustment mechanism 18 (S24). The cold head-side cooling stage 32 physically comes into contact with the sleeve-side cooling stage 48 again. In this case, the cold head-side cooling stage 32 is pressed against the sleeve-side cooling stage 48 due to the own weight of the cold head 22 and a pressure difference between the ambient environment 26 and the airtight region 28.

The cold head-side flange 34 and the sleeve-side flange 50 are fastened to each other again by the flange fastening mechanism 20 (S26). Since the cold head-side flange 34 and the sleeve-side flange 50 are fastened to each other by the flange fastening mechanism 20, the cold head-side cooling stage 32 is pressed against the sleeve-side cooling stage 48 with the pressing contact pressure designated to bring the cold head-side cooling stage 32 and the sleeve-side cooling stage 48 into thermal contact with each other under the thermal resistance equal to or smaller than the threshold. A fastening force is adjusted by the flange fastening mechanism 20, thereby enabling the pressing contact pressure to be adjusted between the cold head-side cooling stage 32 and the sleeve-side cooling stage 48. Therefore, the designated pressing contact pressure, the fastening force, or a fastening torque generated by the flange fastening mechanism 20 corresponding thereto may be described in related documents such as an instruction manual of the cryocooler 10.

The temperature of the cold head-side cooling stage 32 is measured by the cold head-side temperature sensor 56, and the temperature of the sleeve-side cooling stage 48 is measured by the sleeve-side temperature sensor 58. The cold head-side flange 34 is fastened to the sleeve-side flange 50 so that the temperature difference ΔT between the measurement temperature of the cold head-side cooling stage 32 and the measurement temperature of the sleeve-side cooling stage 48 falls within the predetermined temperature difference corresponding to the thermal resistance threshold. In a case where the measured temperature difference ΔT exceeds the predetermined temperature difference, the operator may increase the pressing contact pressure between the cold head-side cooling stage 32 and the sleeve-side cooling stage 48 by causing the flange fastening mechanism 20 to increase the fastening force. In this way, the thermal resistance is monitored so that the cold head-side cooling stage 32 and the sleeve-side cooling stage 48 are in thermal contact with each other under the thermal resistance equal to or smaller than the threshold (S28).

It is desirable that the cold head 22 and the sleeve 16 are brought into thermal contact with each other again (S22) and the thermal resistance is monitored (S28) after the cold head-side cooling stage 32 and the sleeve-side cooling stage 48 are sufficiently cooled by resuming the cooling operation of the cryocooler 10. In this way, it is possible to avoid a possibility that the cold head-side cooling stage 32 and the sleeve-side cooling stage 48 may be separated from each other due to thermal contraction during the cooling operation. In a case where the cold head-side cooling stage 32 is separated from the sleeve-side cooling stage 48 due to the thermal contraction, the fastening force is adjusted by the flange fastening mechanism 20, thereby enabling the cold head-side cooling stage 32 to come into contact with the sleeve-side cooling stage 48 again.

Figure 4:
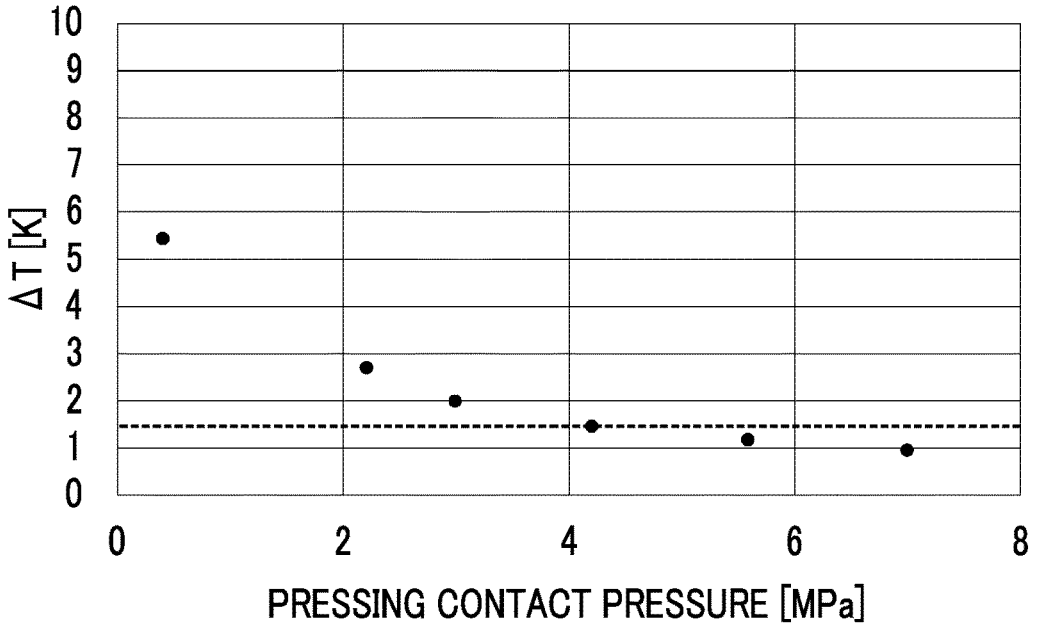
FIG. 4 is graph illustrating a relationship between a temperature difference ΔT and a pressing contact pressure.

FIG. 4 is a graph illustrating a relationship between the temperature difference ΔT and the pressing contact pressure, which is obtained by the present inventor's experiments. The thermal resistance between the cold head-side cooling stage 32 and the sleeve-side cooling stage 48 is conveniently obtained by evaluating the temperature difference ΔT between the measurement temperature of the cold head-side cooling stage 32 and the measurement temperature of the sleeve-side cooling stage 48. If the pressing contact pressure increases between the cold head-side cooling stage 32 and the sleeve-side cooling stage 48, the temperature difference ΔT decreases between the measurement temperature of the cold head-side cooling stage 32 and the measurement temperature of the sleeve-side cooling stage 48. Therefore, the pressing contact pressure is properly designated, thereby enabling the temperature difference ΔT, that is, the thermal resistance to be managed. As described above, the designated pressing contact pressure can be realized by causing the flange fastening mechanism 20 to adjust the fastening force.

As an example, if the temperature difference ΔT falls within 1.5 K or 1 K, the cold head-side cooling stage 32 and the sleeve-side cooling stage 48 are satisfactorily in thermal contact with each other while sufficiently small thermal resistance is present therebetween. Accordingly, for example, the predetermined temperature difference corresponding to the thermal resistance threshold can be set to 1.5 K or 1 K. In the illustrated example, if the pressing contact pressure is designated as approximately 4 MPa or higher, the temperature difference ΔT falls within 1.5K of the predetermined temperature difference. In addition, if the pressing contact pressure is designated as approximately 7 MPa or higher, the temperature difference ΔT falls within 1K of the predetermined temperature difference. Accordingly, the fastening force is adjusted by the flange fastening mechanism 20 so as to obtain the designated pressing contact pressure (for example, approximately 4 MPa or higher or approximately 7 MPa or higher). In this manner, the temperature difference ΔT between the cold head-side cooling stage 32 and the sleeve-side cooling stage 48 falls within 1.5 K or 1 K, and the thermal resistance sufficiently decreases. That is, it is possible to evaluate that the cold head-side cooling stage 32 and the sleeve-side cooling stage 48 are in thermal contact with each other under the thermal resistance equal to or smaller than the thermal resistance threshold.

Figure 5:
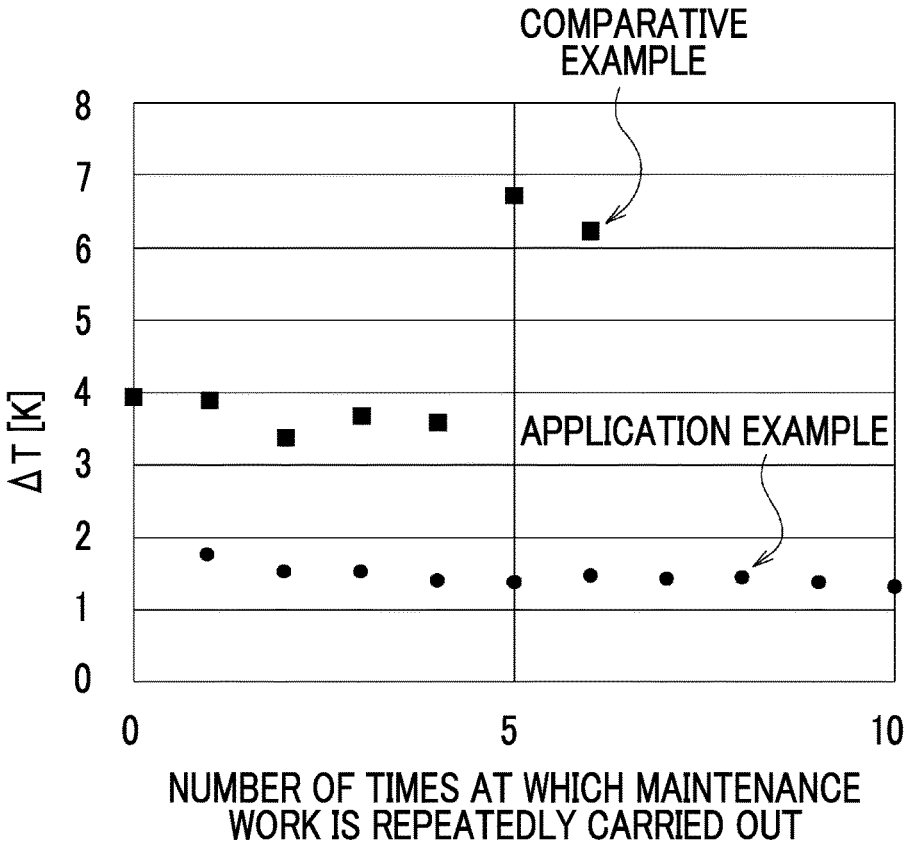
FIG. 5 is a graph illustrating a relationship between the temperature difference ΔT and the number of times at which maintenance work is carried out.

FIG. 5 is a graph illustrating a relationship between the temperature difference ΔT and the number of times at which the maintenance work is carried out, which is obtained by the present inventor's experiments. FIG. 5 illustrates an application example and a comparative example. As described above, in the application example, the indium sheet is not used between the cold head-side cooling stage 32 and the sleeve-side cooling stage 48. In addition, in the application example, the thermal resistance between the cold head-side cooling stage 32 and the sleeve-side cooling stage 48 is managed in accordance with the above-described method. In the comparative example, the indium sheet is interposed on a heat transfer surface between the cold head and the sleeve. In addition, in the comparative example, the thermal resistance on the heat transfer surfaces is not managed.

According to the comparative example, the thermal resistance (that is, the temperature difference ΔT) is maintained substantially constant until the fourth maintenance work is carried out. However, the thermal resistance significantly deteriorates after the fifth maintenance work is carried out (that is, the temperature difference ΔT greatly increases). In this way, the present inventor has found out a phenomenon where a thermal contact state between the cryocooler and the sleeve is likely to deteriorate when the maintenance work is repeatedly carried out several times for the cryocooler. The phenomenon where the thermal contact state deteriorates has not been known so far.

According to the studies of the present inventor, a mechanism which causes the phenomenon where the thermal contact state deteriorates is as follows.

When the cryocooler is separated from the sleeve in order to start the maintenance work, the indium sheet is moved together with the cryocooler, and is detached from the sleeve. When the maintenance work is completely carried out and the cryocooler comes into contact with the sleeve again, the indium sheet also comes into contact with the sleeve again. The indium sheet is repeatedly detached and come into contact with the sleeve again each time the maintenance work is carried out for the cryocooler. A shape of the indium sheet may be changed from an initial flat sheet shape to a shape different from the initial shape, which includes some irregularities. While the maintenance work is carried out, the sleeve is cryogenically held together with the cooling target. On the other hand, the cryocooler restores the room temperature in order to carry out the maintenance work. The indium sheet also restores the room temperature together with the cryocooler. Therefore, at a moment when the indium sheet comes into contact with the sleeve again, the indium sheet may be cooled and hardened by the sleeve. In this way, the indium sheet having the change shape is interposed between the cryocooler and the sleeve. As a result, a heat transfer area between the cryocooler and the sleeve may be reduced by the indium sheet, compared to the indium sheet having the initial shape. Accordingly, the thermal contact state between the cryocooler and the sleeve may deteriorate.

In contrast, according to the application example, even after the maintenance work is repeatedly carried out ten times, the thermal resistance is maintained substantially constant, thereby achieving satisfactory reproducibility. It is conceivable that satisfactory reproducibility is achieved by properly managing the pressing contact pressure. In addition, the absence of the interposed substance such as the indium sheet also contributes to the reproducibility of the thermal resistance.

According to the mounting structure of the cryocooler 10 in the embodiment, the cold head-side flange 34 and the sleeve-side flange 50 are fastened to each other so that the cold head-side cooling stage 32 is pressed against the sleeve-side cooling stage 48 with the designated pressing contact pressure. The pressing contact pressure is designated so that the cold head-side cooling stage 32 and the sleeve-side cooling stage 48 are in thermal contact with each other under the thermal resistance equal to or smaller than the thermal resistance threshold. In this way, the cryocooler 10 mounted on the vacuum vessel 14 via the sleeve 16 can satisfactorily maintain the thermal contact between the cryocooler 10 and the sleeve 16 on a long-term basis, even if the maintenance work is repeatedly carried out for the cryocooler 10.

Figure 6A:
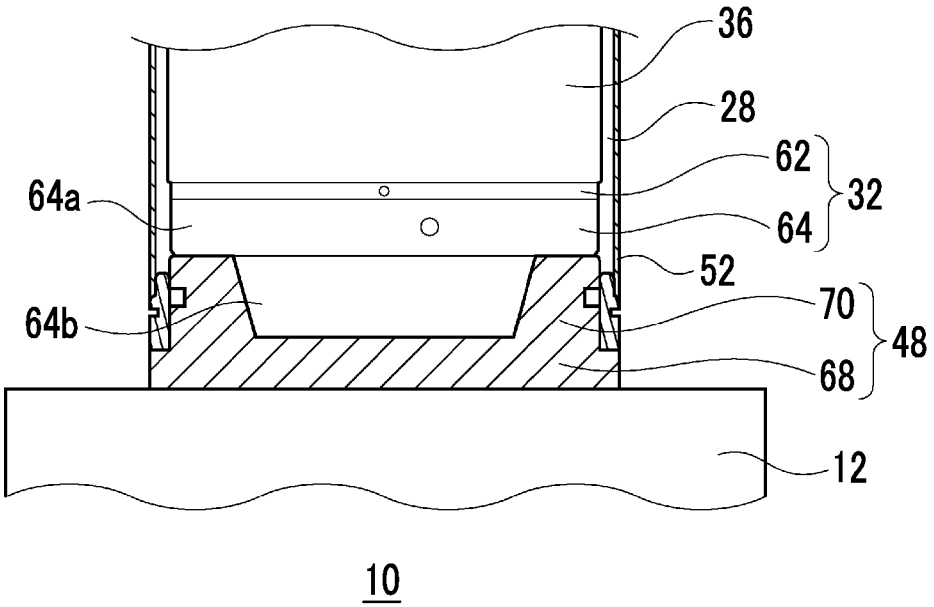
FIGS. 6A and 6B are schematic views illustrating an example of a cooling stage structure which can be used for a cryocooler according to the embodiment.
Figure 6B:
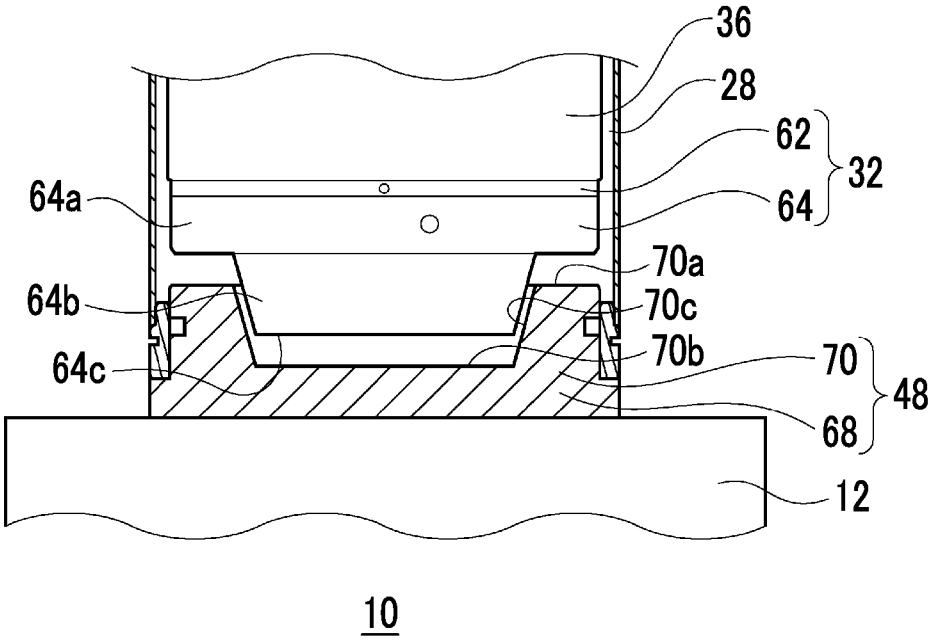

FIGS. 6A and 6B are schematic views illustrating an example of a cooling stage structure which can be used for the cryocooler 10 according to the embodiment. FIG. 6A illustrates a state where the cold head-side cooling stage 32 and the sleeve-side cooling stage 48 are in the thermal contact with each other, and FIG. 6B illustrates a state where the cold head-side cooling stage 32 is separated from the sleeve-side cooling stage 48 so that the thermal contact is released therebetween.

The cold head-side cooling stage 32 includes a cold head-side thermal load flange 62 and a cold head-side heat transfer block 64. The cold head-side heat transfer block 64 has a non-sheet shape. Aside surface and a lower surface of the cold head-side heat transfer block 64 are exposed to the airtight region 28. As an example, the cold head-side thermal load flange 62 is a disk-shaped member fixedly attached to the cylinder 36 so as to close the lower end opening of the cylinder 36. The cold head-side heat transfer block 64 is a disk-shaped member attached to the cold head-side thermal load flange 62. The cold head-side heat transfer block 64 is an attachment detachably attached to the cold head-side thermal load flange 62, and is attached to the cold head-side thermal load flange 62 by using a fastening member (not illustrated) such as a bolt, for example.

For example, the cold head-side thermal load flange 62 and the cold head-side heat transfer block 64 are formed of a highly heat conductive metal such as copper or other heat conductive materials. The cold head-side thermal load flange 62 and the cold head-side heat transfer block 64 are not formed of indium. That is, both of these do not contain the indium (except for inevitable impurities). Here, the cold head-side thermal load flange 62 and the cold head-side heat transfer block 64 are formed of the same heat conductive material. However, both of these may not necessarily be formed of the same heat conductive material, and may be formed of mutually different heat conductive materials.

Figure 7:
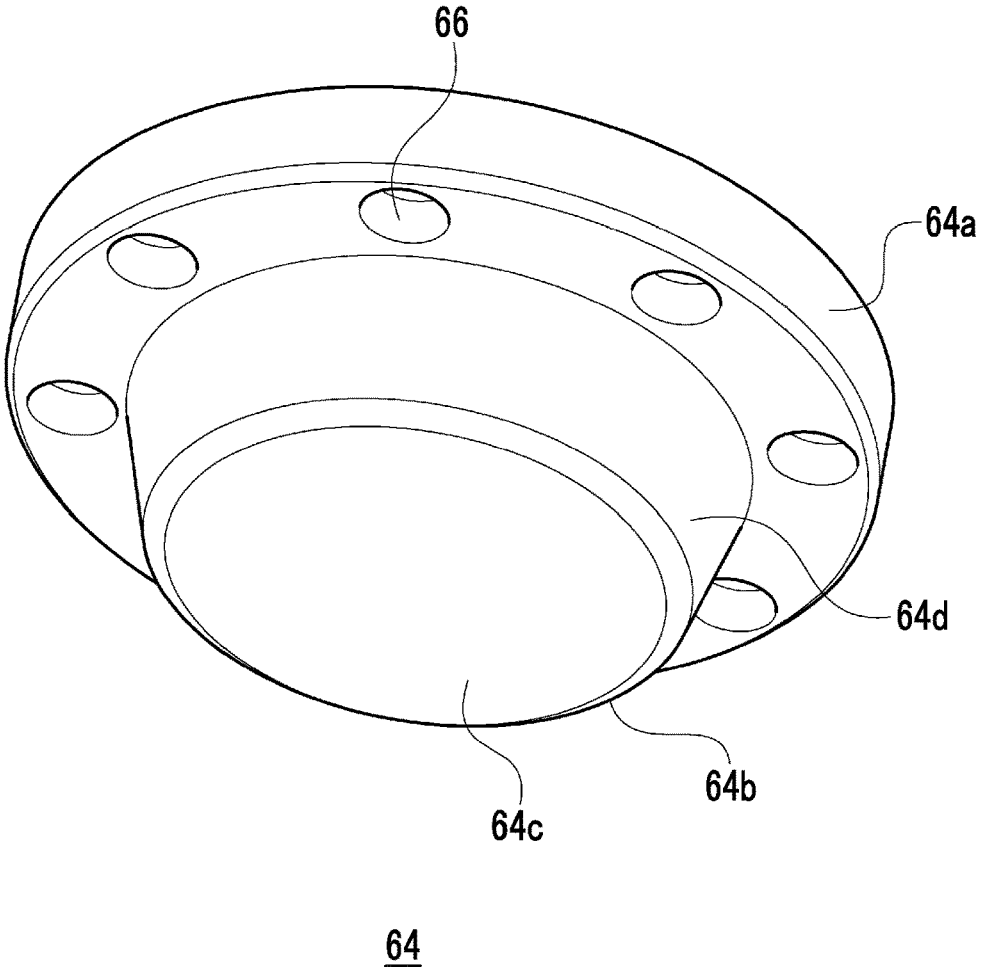
FIG. 7 is a schematic perspective view illustrating an exemplary configuration of a cold head-side heat transfer block according to the embodiment.

FIG. 7 is a schematic perspective view illustrating an exemplary configuration of the cold head-side heat transfer block 64 according to the embodiment. The cold head-side heat transfer block 64 includes a block base portion 64*a* and a block central projection portion 64*b*. The block base portion 64*a* and the block central projection portion 64*b* are formed integrally with each other. The block base portion 64*a* has a plurality of bolt holes 66 for attaching the cold head-side heat transfer block 64 to the cold head-side thermal load flange 62. The bolt holes are circumferentially arranged at an equal angular interval.

The block central projection portion 64*b* projects downward in the axial direction from a central portion of the block base portion 64*a*. As an example, the block central projection portion 64*b* is a projection portion having a truncated cone shape, and has a flat block end surface 64*c* and a tapered surface 64*d*. The block end surface 64*c* is a circular region perpendicular to the central axis of the cryocooler 10, and the tapered surface 64*d* is an inclined surface corresponding to a side surface of the truncated cone. For example, a tapered angle is 15 degrees, that is, an angle formed between the block end surface 64*c* and the tapered surface 64*d* is 105 degrees. Since the tapered surface 64*d* is disposed in this way, it is possible to increase a surface area where the cold head-side heat transfer block 64 is in contact with the sleeve-side cooling stage 48. Therefore, it is possible to improve heat exchange efficiency between the cold head-side cooling stage 32 and the sleeve-side cooling stage 48.

Figure 8:
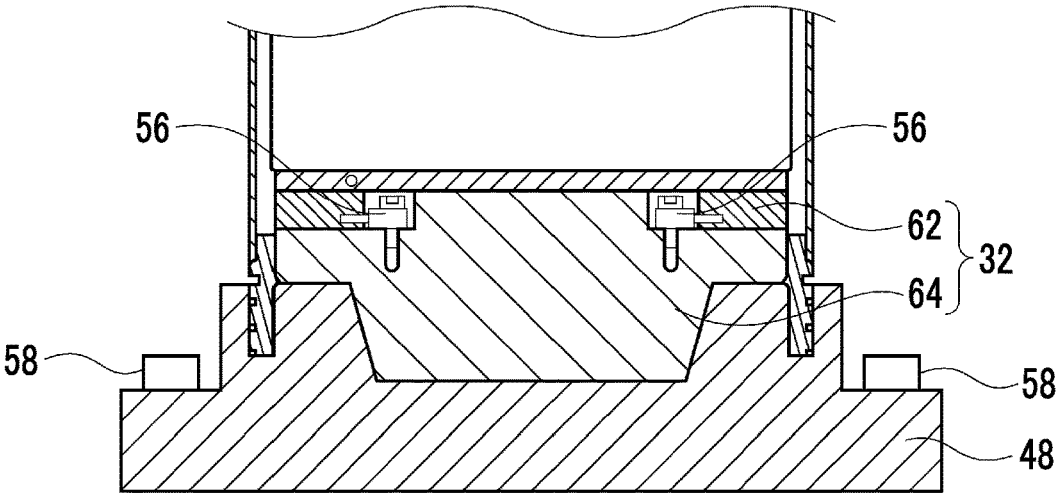
FIG. 8 is a schematic sectional view illustrating an exemplary configuration of the cold head-side heat transfer block and a peripheral structure thereof according to the embodiment.

FIG. 8 is a schematic sectional view illustrating an exemplary configuration of the cold head-side heat transfer block 64 and a peripheral structure thereof according to the embodiment. As illustrated in FIG. 8, the cold head-side temperature sensor 56 is located between the cold head-side thermal load flange 62 and the cold head-side heat transfer block 64. For example, the cold head-side temperature sensor 56 is attached to the cold head-side heat transfer block 64. As an example, two cold head-side temperature sensors 56 are disposed for a redundant purpose. Similarly, two sleeve-side temperature sensors 58 are disposed in the sleeve-side cooling stage 48 for a redundant purpose.

Referring back to FIGS. 6A and 6B, the sleeve-side cooling stage 48 includes a sleeve-side thermal load flange 68 and a sleeve-side heat transfer block 70. The sleeve-side thermal load flange 68 is a disk-shaped member fixedly attached to the sleeve body 52 so as to close the lower end opening of the sleeve body 52. The cooling target 12 is attached to the sleeve-side thermal load flange 68. The sleeve-side heat transfer block 70 has a non-sheet shape. An upper surface of the sleeve-side heat transfer block 70 is exposed to the airtight region 28. The sleeve-side thermal load flange 68 and the sleeve-side heat transfer block 70 are formed integrally with each other.

The sleeve-side heat transfer block 70 has a central recess portion corresponding to the block central projection portion 64*b* of the cold head-side heat transfer block 64. The sleeve-side heat transfer block 70 has a block upper surface 70*a*, a block lower surface 70*b*, and an inclined surface 70*c*, which corresponds to the block base portion 64*a*, the block end surface 64*c*, and the tapered surface 64*d* of the cold head-side heat transfer block 64. When the cold head-side heat transfer block 64 comes into contact with the sleeve-side heat transfer block 70, the block base portion 64*a*, the block end surface 64*c*, and the tapered surface 64*d* respectively come into contact with the block upper surface 70*a*, the block lower surface 70*b*, and the inclined surface 70*c*. When the cold head-side heat transfer block 64 is separated from the sleeve-side heat transfer block 70, the block base portion 64*a*, the block end surface 64*c*, and the tapered surface 64*d* are respectively separated from the block upper surface 70*a*, the block lower surface 70*b*, and the inclined surface 70*c*.

For example, the sleeve-side thermal load flange 68 and the sleeve-side heat transfer block 70 are formed of a highly heat conductive metal such as copper or other heat conductive materials. The sleeve-side thermal load flange 68 and the sleeve-side heat transfer block 70 are formed of indium. That is, both of these do not contain the indium (except for inevitable impurities). Here, the sleeve-side thermal load flange 68 and the sleeve-side heat transfer block 70 are formed of the same heat conductive material. However, both of these may not necessarily be formed of the same heat conductive material, and may be formed of mutually different heat conductive materials.

The cold head-side heat transfer block 64 and the sleeve-side heat transfer block 70 directly come into physical contact with each other. In this manner, the cold head-side cooling stage 32 and the sleeve-side cooling stage 48 are brought into thermal contact with each other. The cold head-side heat transfer block 64 and the sleeve-side heat transfer block 70 directly come into physical contact with each other. Accordingly, the interposed substance for heat transfer such as the indium sheet is not present therebetween. In this way, the interposed substance for heat transfer such as the indium sheet is absent. Therefore, it is possible to realize the satisfactory thermal contact between the cold head-side cooling stage 32 and the sleeve-side cooling stage 48.

Figure 9:
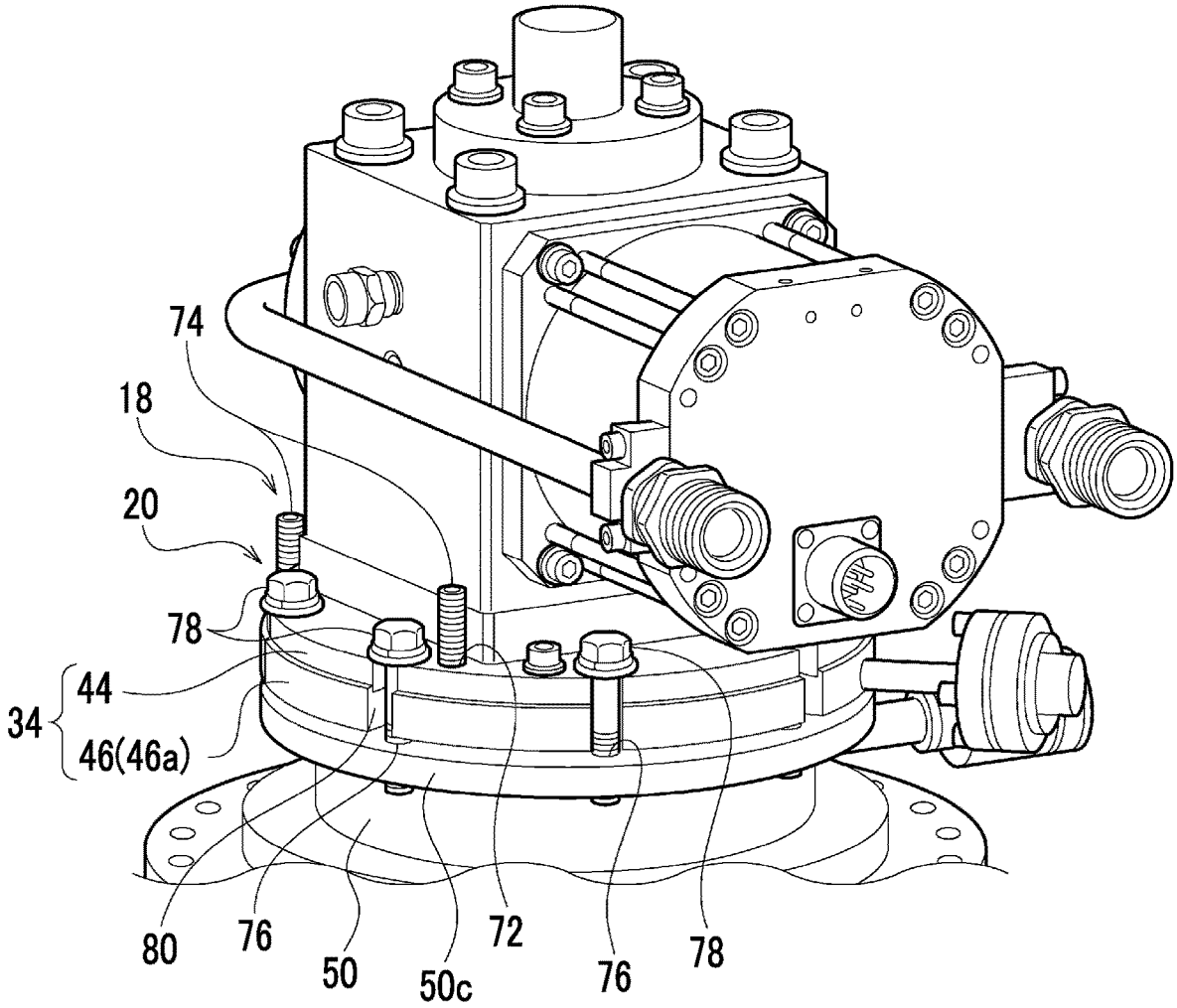
FIG. 9 is a schematic perspective view illustrating each example of an inter-flange distance adjustment mechanism and a flange fastening mechanism which can be used for the cryocooler according to the embodiment.
Figure 10:
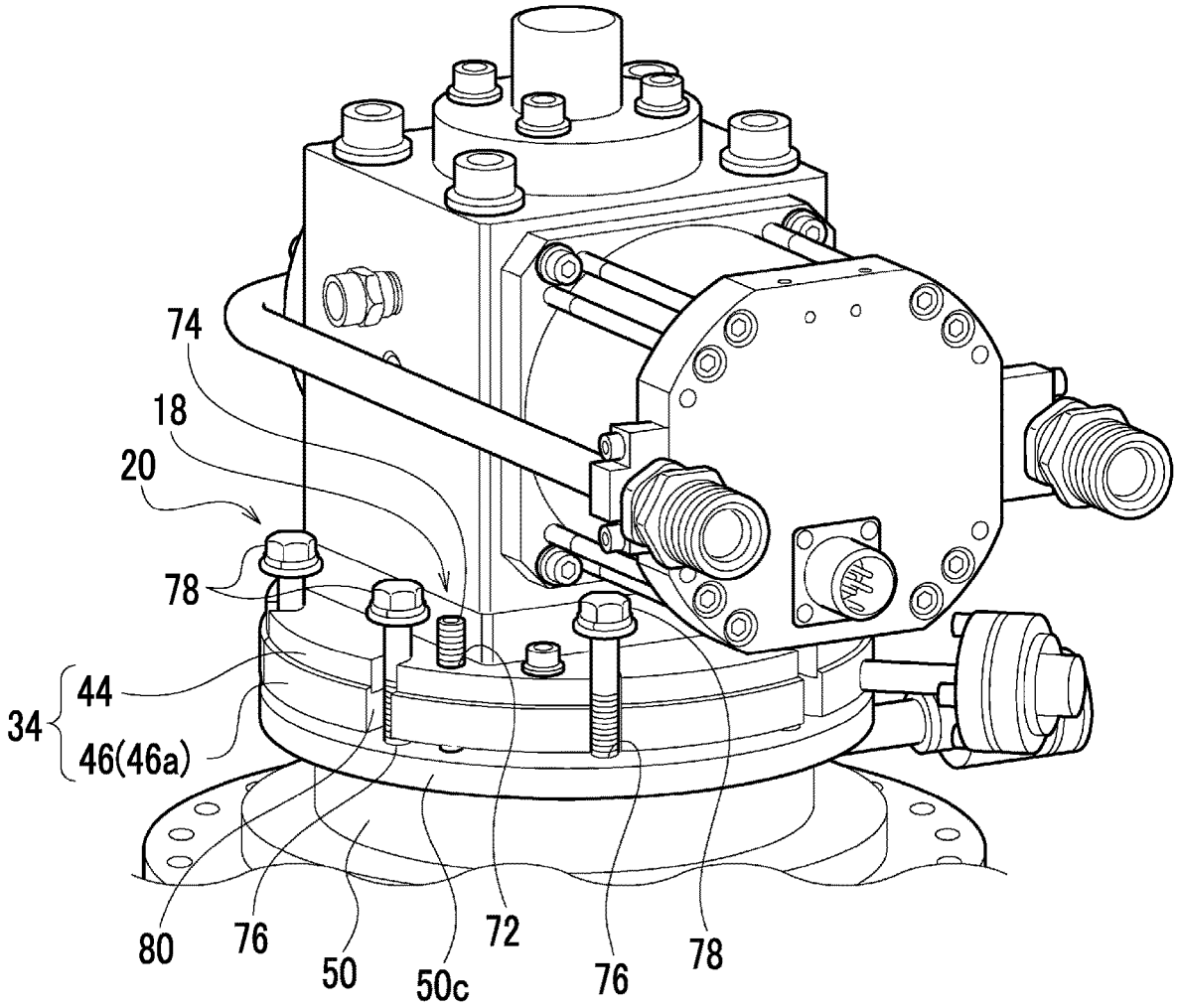
FIG. 10 is a schematic perspective view illustrating each example of the inter-flange distance adjustment mechanism and the flange fastening mechanism which can be used for the cryocooler according to the embodiment.

FIGS. 9 and 10 are schematic perspective views illustrating each example of the inter-flange distance adjustment mechanism 18 and the flange fastening mechanism 20 which can be used for the cryocooler according to the embodiment. FIG. 9 illustrates a state where the cryocooler 10 is thermally coupled with the cooling target 12 in the same manner as in FIG. 1, and FIG. 10 illustrates a state where the cryocooler 10 is thermally uncoupled from the cooling target 12 in the same manner as in FIG. 2.

The flange distance adjustment mechanism 18 includes a lift-up bolt hole 72 formed in the cold head-side flange 34 and a lift-up bolt 74 screwed into the lift-up bolt hole 72. The flange distance adjustment mechanism 18 is configured to raise and lower the cold head-side flange 34 to and from the sleeve-side flange 50 by rotating the lift-up bolt 74 in a state where the lift-up bolt 74 butts against the sleeve-side flange 50.

The lift-up bolt holes 72 are circumferentially arranged at an equal angular interval in the cold head-side flange 34. As an example, the cold head-side flange 34 has four lift-up bolt holes 72. The lift-up bolt hole 72 penetrates the cylinder flange 44 and the annular plate portion 46*a* of the transition flange 46.

In the sleeve-side flange 50, there is no hole in a portion located immediately below the lift-up bolt hole 72. Therefore, a tip of the lift-up bolt 74 can butt against the annular second plate portion 50*c* of the sleeve-side flange 50. As described above, the lift-up bolt 74 is screwed into the lift-up bolt hole 72. Therefore, the lift-up bolt 74 is rotated in a fastening direction (for example, clockwise) in a state where the tip of the lift-up bolt 74 butts against the annular second plate portion 50*c*. In this manner, the cold head-side flange 34 can be moved upward so that the cold head-side flange 34 is separated from the sleeve-side flange 50. In this way, the inter-flange distance adjustment mechanism 18 can broaden the distance between the sleeve-side flange 50 and the cold head-side flange 34, and the cold head 22 can be raised from the sleeve 16. As a result, as illustrated in FIG. 2, the cold head-side cooling stage 32 is separated from the sleeve-side cooling stage 48, thereby releasing the thermal contact therebetween.

Conversely, the lift-up bolt 74 is rotated in an unfastening direction (for example, counterclockwise) in a state where the tip of the lift-up bolt 74 butts against the annular second plate portion 50*c*. In this manner, the cold head-side flange 34 can be moved downward so that the cold head-side flange 34 moves close to the sleeve-side flange 50. In this way, the inter-flange distance adjustment mechanism 18 can narrow the distance between the sleeve-side flange 50 and the cold head-side flange 34, and the cold head 22 can be lowered. As a result, as illustrated in FIG. 1, the cold head-side cooling stage 32 physically comes into contact with the sleeve-side cooling stage 48, thereby realizing the thermal contact therebetween. If the lift-up bolt 74 is further rotated in the unfastening direction (for example, counterclockwise), the tip of the lift-up bolt 74 is separated from the sleeve-side flange 50.

In this way, according to a relatively simple structure in which the lift-up bolt hole 72 and the lift-up bolt 74 are combined with each other, it is possible to adjust the distance between the cold head-side flange 34 and the sleeve-side cooling stage 48.

The flange fastening mechanism 20 includes a fastening bolt hole 76 formed in the sleeve-side flange 50 and a fastening bolt 78 screwed into the fastening bolt hole 76. The flange fastening mechanism 20 is configured to adjust the pressing contact pressure of the cold head-side cooling stage 32 and the sleeve-side cooling stage 48 by rotating the fastening bolt 78.

The fastening bolt holes 76 are circumferentially arranged at an equal angular interval in the sleeve-side flange 50. As an example, the sleeve-side flange 50 has eight fastening bolt holes 76. The fastening bolt 78 penetrates both the cold head-side flange 34 and the sleeve-side flange 50. However, the fastening bolt 78 is loosely fitted to the cold head-side flange 34. Therefore, the fastening bolt 78 is not screwed to the cold head-side flange 34. The fastening bolt 78 is accommodated in a cutout portion 80 formed in the cold head-side flange 34. For example, the cutout portion 80 is a U-shaped groove formed in an outer peripheral edge of the cold head-side flange 34 and extending in the axial direction.

Ahead portion of the fastening bolt 78 may come into contact with the upper surface of the cold head-side flange 34, that is, the cylinder flange 44.

In a state where the cold head-side cooling stage 32 is physically in contact with the sleeve-side cooling stage 48, the fastening bolt 78 is rotated in the fastening direction. In this manner, a fastening force between the cold head-side flange 34 and the sleeve-side flange 50 increases, and the pressing contact pressure between the cold head-side cooling stage 32 and the sleeve-side cooling stage 48 also increases. Conversely, the fastening bolt 78 is rotated in the unfastening direction. In this manner, the fastening force between the cold head-side flange 34 and the sleeve-side flange 50 decreases, and the pressing contact pressure of the cold head-side cooling stage 32 and the sleeve-side cooling stage 48 also decreases.

In this way, according to a relatively simple structure in which the fastening bolt hole 76 and the fastening bolt 78 are combined with each other, it is possible to adjust the pressing contact pressure between the cold head-side flange 34 and the sleeve-side cooling stage 48.

Figure 11:
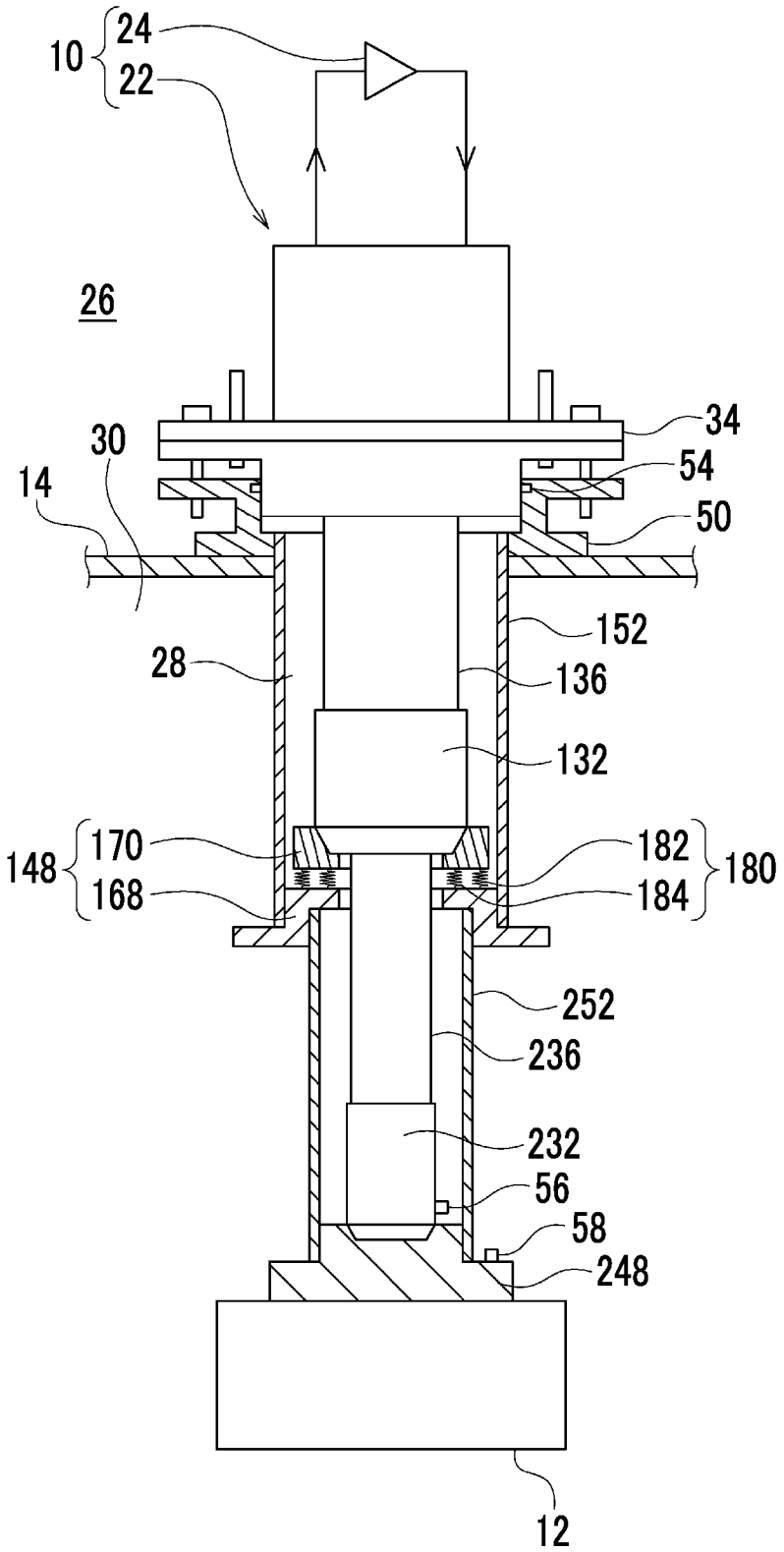
FIG. 11 is a schematic view for describing a mounting structure according to another embodiment.
Figure 12:
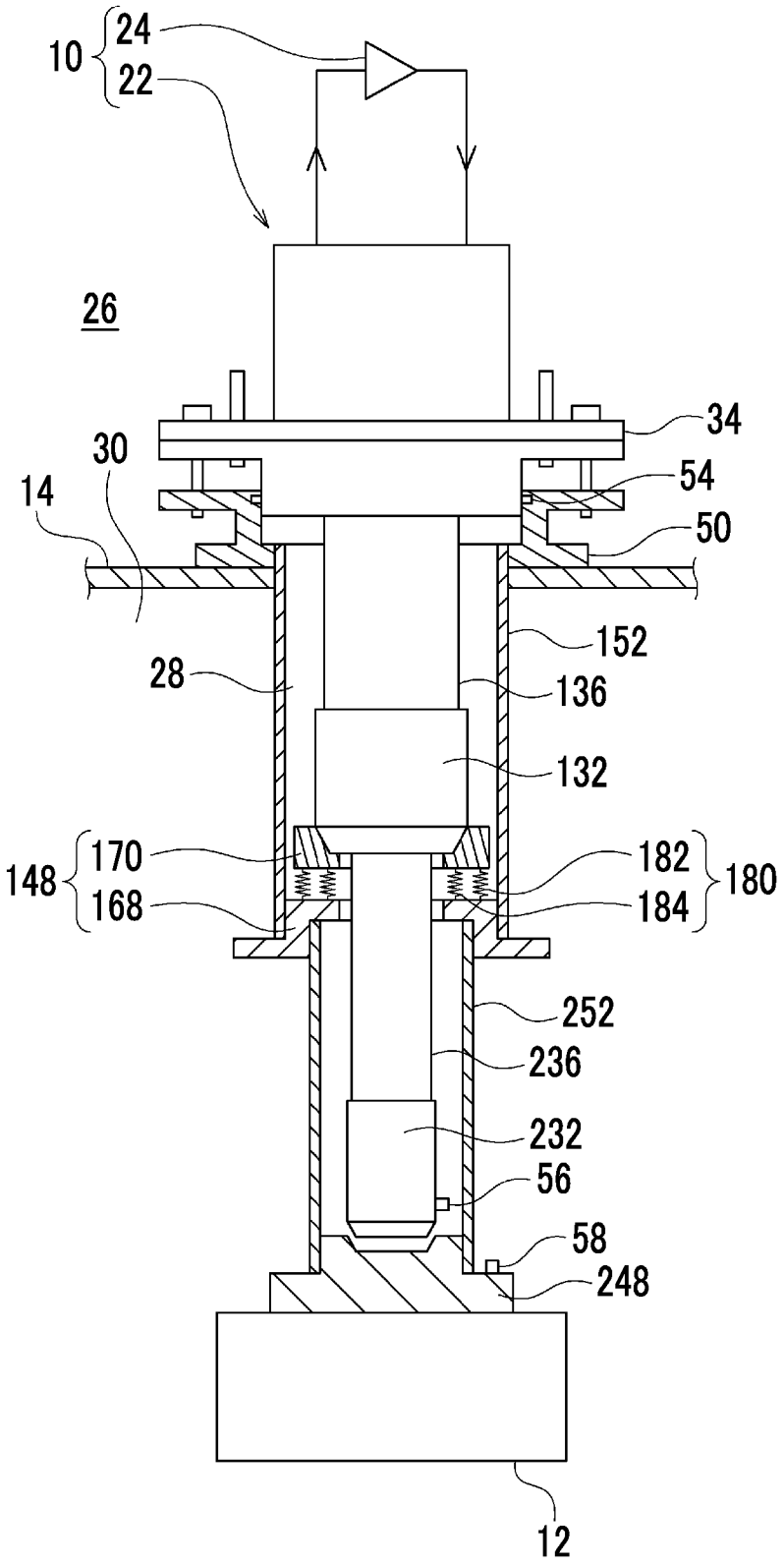
FIG. 12 is a schematic view for describing a mounting structure according to further another embodiment.
Figure 13:
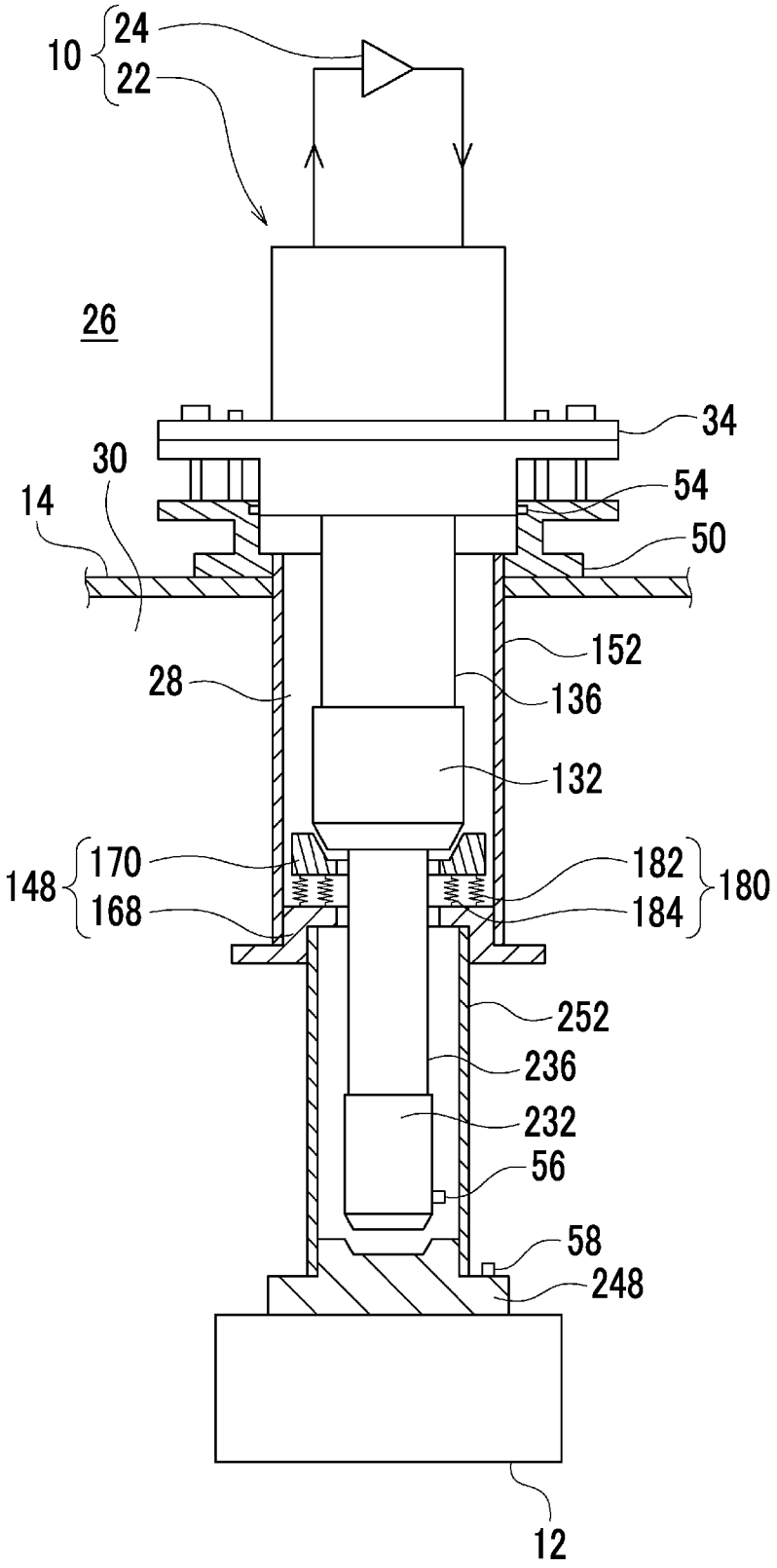
FIG. 13 is a schematic view for describing a mounting structure according to still another embodiment.

FIGS. 11 to 13 are schematic views for describing a mounting structure according to another embodiment. In this embodiment, the cryocooler 10 includes a two-stage cold head 22 and the compressor 24. Accordingly, the mounting structure includes a two-stage sleeve 16, the inter-flange distance adjustment mechanism 18, and the flange fastening mechanism 20. For example, the cryocooler 10 is a two-stage GM cryocooler. However, the cryocooler 10 may be other two-stage cryocoolers.

FIG. 11 illustrates a state where the cold head 22 and the sleeve 16 are in thermal contact with each other in both the first stage and the second stage. FIG. 12 illustrates a state where the thermal contact is maintained for the first stage and the thermal contact is released for the second stage. FIG. 13 illustrates a state where the thermal contact is released for both the first stage and the second stage.

The cold head 22 includes a cold head-side first cooling stage 132, a first stage cylinder 136, a cold head-side second cooling stage 232, and a second stage cylinder 236. The first stage cylinder 136 links the cold head-side flange 34 to the cold head-side first cooling stage 132, and the second stage cylinder 236 links the cold head-side first cooling stage 132 to the cold head-side second cooling stage 232. The first stage cylinder 136 and the second stage cylinder 236 are arranged coaxially with each other.

For example, the cold head-side first cooling stage 132 and the cold head-side second cooling stage 232 are formed of a highly heat conductive metal such as copper (for example, pure copper) or other heat conductive materials. For example, the first stage cylinder 136 and the second stage cylinder 236 are formed of metal such as stainless steel. The thermal conductivity of the heat conductive material for forming the cooling stage is higher than the thermal conductivity of the material for forming the cylinder.

The sleeve 16 includes a sleeve-side first cooling stage 148, a first stage sleeve body 152, a sleeve-side second cooling stage 248, and a second stage sleeve body 252. The first stage sleeve body 152 links the sleeve-side flange 50 to the sleeve-side first cooling stage 148, and the second stage sleeve body 252 links the sleeve-side first cooling stage 148 to the sleeve-side second cooling stage 248. The first stage sleeve body 152 and the second stage sleeve body 252 are respectively arranged coaxially with the first stage cylinder 136 and the second stage cylinder 236 so as to surround the first stage cylinder 136 and the second stage cylinder 236.

The sleeve-side first cooling stage 148 comes into thermal contact with the cold head-side first cooling stage 132 by coming into physical contact with the cold head-side first cooling stage 132. The sleeve-side second cooling stage 248 comes into thermal contact with the cold head-side second cooling stage 232 by coming into physical contact with the cold head-side second cooling stage 232. Similar to the embodiment described with reference to FIGS. 1 to 10, a shape of a contact surface between the sleeve-side cooling stage and the cold head-side cooling stage may be a tapered surface, an inclined surface, or a non-flat surface such as an irregular surface. Alternatively, the shape may be a flat surface.

For example, the sleeve-side first cooling stage 148 and the sleeve-side second cooling stage 248 are formed of a highly heat conductive metal such as copper (for example, pure copper) or other heat conductive materials. For example, the first stage sleeve body 152 and the second stage sleeve body 252 are formed of metal such as stainless steel. The thermal conductivity of the heat conductive material for forming the cooling stage is higher than the thermal conductivity of the material for forming the sleeve body.

The cooling target 12 is attached to an outer surface of the sleeve-side second cooling stage 248 exposed to the vacuum region 30. Another cooling target different from the cooling target 12 (for example, a heat shield for surrounding the cooling target 12) may be attached to an outer surface of the sleeve-side first cooling stage 148 exposed to the vacuum region 30.

A central portion of the sleeve-side first cooling stage 148 has an opening portion which connects an internal space of the first stage sleeve body 152 to an internal space of the second stage sleeve body 252. The second stage cylinder 236 and the cold head-side second cooling stage 232 are inserted from the opening portion into the internal space of the second stage sleeve body 252.

The sleeve-side first cooling stage 148 includes a sleeve-side first stage thermal load flange 168, a sleeve-side first stage heat transfer block 170, and a heat transfer spring mechanism 180. The sleeve-side first stage thermal load flange 168 is fixedly attached to a lower end of the first stage sleeve body 152. The sleeve-side first stage heat transfer block 170 is accommodated in the airtight region 28, and is attached to the sleeve-side first stage thermal load flange 168 via the heat transfer spring mechanism 180. The sleeve-side first stage heat transfer block 170 is displaceable in the axial direction with respect to the sleeve-side first stage thermal load flange 168 by stretching movement of the heat transfer spring mechanism 180. The sleeve-side first stage thermal load flange 168 and the sleeve-side first stage heat transfer block 170 are annular members arranged coaxially with each other. As described above, through a central opening portion thereof, the second stage cylinder 236 and the cold head-side second cooling stage 232 are inserted into the internal space of the second stage sleeve body 252.

The heat transfer spring mechanism 180 includes a heat transfer spring portion 182 and a support spring portion 184. The heat transfer spring portion 182 and the support spring portion 184 are disposed in parallel with each other between the sleeve-side first stage thermal load flange 168 and the sleeve-side first stage heat transfer block 170. That is, the heat transfer spring portion 182 connects the sleeve-side first stage heat transfer block 170 to the sleeve-side first stage thermal load flange 168. Similarly, the support spring portion 184 connects the sleeve-side first stage heat transfer block 170 to the sleeve-side first stage thermal load flange 168. The sleeve-side first stage heat transfer block 170 is elastically supported by the sleeve-side first stage thermal load flange 168 by the heat transfer spring portion 182 and the support spring portion 184.

The heat transfer spring portion 182 functions as a heat transfer passage from the sleeve-side first stage heat transfer block 170 to the sleeve-side first stage thermal load flange 168. For example, the heat transfer spring portion 182 is a spring formed of a highly heat conductive metal such as copper or other heat conductive materials. For example, the heat transfer spring portion 182 may have a coil spring shape or any other desired shape. The heat transfer spring portion 182 may have a spring constant which is smaller than that of the support spring portion 184.

When the cold head-side first cooling stage 132 is pressed against the sleeve-side first stage heat transfer block 170, the support spring portion 184 allows the cold head-side first cooling stage 132 and the sleeve-side first stage heat transfer block 170 to sink in the axial direction. In addition, the support spring portion 184 has a function to suppress excessive sinking of the cold head-side first cooling stage 132 and the sleeve-side first stage heat transfer block 170. As described above, the main heat transfer passage is the heat transfer spring portion 182, but the support spring portion 184 may have a heat transfer function to some extent. For example, the support spring portion 184 is a spring formed of a metallic material or other suitable materials. For example, the support spring portion 184 may have a coil spring shape, a disk spring shape, or any other desired shape.

Since the cold head-side first cooling stage 132 and the sleeve-side first stage heat transfer block 170 come into physical contact with each other, the cold head-side first cooling stage 132 and the sleeve-side first stage heat transfer block 170 come into thermal contact with each other. The sleeve-side first stage heat transfer block 170 comes into thermal contact with the sleeve-side first stage thermal load flange 168 via the heat transfer spring mechanism 180. In this way, the cold head-side first cooling stage 132 comes into thermal contact with the sleeve-side first cooling stage 148.

In addition, the sleeve-side first stage heat transfer block 170 is displaceable in the axial direction with respect to the sleeve-side first stage thermal load flange 168 by elastically deforming the heat transfer spring portion 182 and the support spring portion 184. When the cold head-side first cooling stage 132 is pressed against the sleeve-side first stage heat transfer block 170, the cold head-side first cooling stage 132 is elastically displaceable in the axial direction together with the sleeve-side first stage heat transfer block 170.

It is not essential that the heat transfer spring mechanism 180 has the heat transfer spring portion 182. Instead of the heat transfer spring portion 182, the heat transfer spring mechanism 180 may have a flexible heat transfer member such as a bellows, a mesh-like substance, or a membrane.

It is not essential that the heat transfer spring mechanism 180 has the heat transfer spring portion 182 and the support spring portion 184 as separate springs. The heat transfer spring mechanism 180 may have a single spring member having both the heat transfer function and the support function.

It is not essential that the heat transfer spring mechanism 180 is incorporated in the sleeve-side first cooling stage 148. The heat transfer spring mechanism 180 may be incorporated in the cold head-side first cooling stage 132. For example, the cold head-side first cooling stage 132 may include a cold head-side thermal load flange, a cold head-side heat transfer block, and the heat transfer spring mechanism 180. The cold head-side thermal load flange may be fixedly attached to the lower end of the first stage cylinder 136, and the cold head-side heat transfer block may be attached to the cold head-side thermal load flange via the heat transfer spring mechanism 180. The cold head-side heat transfer block may come into thermal contact with the sleeve-side first cooling stage 148, and the cold head-side thermal load flange may be displaceable in the axial direction by elastically deforming the heat transfer spring mechanism 180.

In addition, the cold head-side temperature sensor 56 is located in the cold head-side second cooling stage 232 in order to measure the temperature of the cold head-side second cooling stage 232. The sleeve-side temperature sensor 58 is located in the sleeve-side second cooling stage 248 in order to measure the temperature of the sleeve-side second cooling stage 248.

The cold head-side second cooling stage 232 and the sleeve-side second cooling stage 248 have the same configuration as that of the cold head-side cooling stage 32 and the sleeve-side cooling stage 48 According to the embodiment described with reference to FIGS. 1 to 10. Accordingly, when the cold head-side second cooling stage 232 comes into in physical contact with the sleeve-side second cooling stage 248, the cold head-side second cooling stage 232 is thermally coupled with the cooling target 12 via the sleeve-side second cooling stage 248. Accordingly, the cooling target 12 can be cooled by cooling the cold head-side second cooling stage 232.

Amounting method according to the embodiment will be described with reference to FIGS. 11 to 13. This method is basically the same as the method illustrated in FIG. 3.

At a timing for allowing the maintenance work to be carried out for the cryocooler 10, the cooling operation of the cryocooler 10 is stopped. In this case, as illustrated in FIG. 11, the cold head-side first cooling stage 132 physically and thermally comes into contact with the sleeve-side first cooling stage 148, and the cold head-side second cooling stage 232 physically and thermally comes into contact with the sleeve-side second cooling stage 248.

First, the operator operates the flange fastening mechanism 20, thereby unfastening the cold head-side flange 34 and the sleeve-side flange 50 from each other. As illustrated in FIG. 12, the cold head 22 is raised to some extent with an elastic force of the heat transfer spring mechanism 180. In this manner, the physical contact is released between the cold head-side second cooling stage 232 and the sleeve-side second cooling stage 248, and the cryocooler 10 and the cooling target 12 are thermally uncoupled from each other. The cold head-side first cooling stage 132 is in contact with the sleeve-side first cooling stage 148.

The operator operates the inter-flange distance adjustment mechanism 18, thereby further raising the cold head 22. As illustrated in FIG. 13, while the isolation of the airtight region 28 from the ambient environment 26 is maintained, the distance between the sleeve-side flange 50 and the cold head-side flange 34 is adjusted so that the cold head-side first cooling stage 132 is not physically in contact with the sleeve-side first cooling stage 148. The seal member 54 is disposed between the cold head-side flange 34 and the sleeve-side flange 50. Therefore, the isolation of the airtight region 28 from the ambient environment 26 is maintained.

In this way, the cold head-side first cooling stage 132 and the cold head-side second cooling stage 232 are not respectively and thermally in contact with the sleeve-side first cooling stage 148 and the sleeve-side second cooling stage 248. The cold head 22 can be heated while the cooling target 12 is maintained at a low temperature.

The maintenance work is carried out for of the cryocooler 10. The drive unit and the displacer of the cold head 22 are detached from the cold head 22. The cold head-side first cooling stage 132, the first stage cylinder 136, the cold head-side second cooling stage 232, and the second stage cylinder 236 are installed in the sleeve 16 without any change. Then, the drive unit and the displacer for which the maintenance work is completely carried out (or new products) are attached to the cold head 22. Then, the cooling operation of the cryocooler 10 is resumed.

The operator operates the inter-flange distance adjustment mechanism 18 and the flange fastening mechanism 20 again. In this manner, the cryocooler 10 and the cooling target 12 are thermally coupled with each other again. The flange distance adjustment mechanism 18 adjusts the distance between the sleeve-side flange 50 and the cold head-side flange 34, and the cold head 22 is lowered. As illustrated in FIG. 12, in a state where the isolation of the airtight region 28 from the ambient environment 26 is maintained, the cold head-side first cooling stage 132 physically and thermally comes into contact with the sleeve-side first cooling stage 148 again. In this case, the cold head-side second cooling stage 232 and the sleeve-side second cooling stage 248 are not in contact with each other.

The flange fastening mechanism 20 fastens the cold head-side flange 34 and the sleeve-side flange 50 to each other again. Since the cold head-side flange 34 and the sleeve-side flange 50 are fastened to each other by the flange fastening mechanism 20, the heat transfer spring mechanism 180 is compressed. The cold head-side first cooling stage 132 and the sleeve-side first stage heat transfer block 170 sink toward the sleeve-side first stage thermal load flange 168. In this manner, as illustrated in FIG. 11, the cold head-side second cooling stage 232 and the sleeve-side second cooling stage 248 physically come into contact with each other.

Both of these are further fastened to each other. Accordingly, the cold head-side second cooling stage 232 is pressed against the sleeve-side second cooling stage 248 with the pressing contact pressure designated so that the cold head-side second cooling stage 232 and the sleeve-side second cooling stage 248 thermally come into contact with each other under the thermal resistance equal to or smaller than the threshold. Since the fastening force is adjusted by the flange fastening mechanism 20, it is possible to adjust the pressing contact pressure between the cold head-side second cooling stage 232 and the sleeve-side second cooling stage 248.

The temperature of the cold head-side second cooling stage 232 is measured by the cold head-side temperature sensor 56, and the temperature of the sleeve-side second cooling stage 248 is measured by the sleeve-side temperature sensor 58. The cold head-side flange 34 is fastened to the sleeve-side flange 50 so that the temperature difference $\Delta T$ between the measurement temperature of the cold head-side second cooling stage 232 and the measurement temperature of the sleeve-side second cooling stage 248 falls within the predetermined temperature difference corresponding to the thermal resistance threshold. In a case where the measured temperature difference $\Delta T$ exceeds the predetermined temperature difference, the operator may increase the fastening force by using the flange fastening mechanism 20 so as to increase the pressing contact pressure between the cold head-side second cooling stage 232 and the sleeve-side second cooling stage 248. In this way, the thermal resistance is monitored so that the cold head-side second cooling stage 232 and the sleeve-side second cooling stage 248 thermally come into contact with each other under the thermal resistance equal to or smaller than the threshold.

According to the mounting structure of the cryocooler 10 according to the embodiment described with reference to FIGS. 11 to 13, the cold head-side flange 34 and the sleeve-side flange 50 are fastened to each other so that the cold head-side second cooling stage 232 is pressed against the sleeve-side second cooling stage 248 with the designated pressing contact pressure. The pressing contact pressure is designated so that the cold head-side second cooling stage 232 and the sleeve-side second cooling stage 248 thermally come into contact with each other under the thermal resistance equal to or smaller than the thermal resistance threshold. In this way, the cryocooler 10 mounted on the vacuum vessel 14 via the sleeve 16 can satisfactorily maintain the thermal contact between the cryocooler 10 and the sleeve 16 on a long-term basis, even if the maintenance work is repeatedly carried out for the cryocooler 10.

In addition, the heat transfer spring mechanism 180 is incorporated in the sleeve-side first cooling stage 148 (or the cold head-side first cooling stage 132). Accordingly, the cold head-side first cooling stage 132 and the sleeve-side first cooling stage 148 come into thermal contact with each other via the heat transfer spring mechanism 180. Therefore, while the thermal contact is maintained between the cold head-side first cooling stage 132 and the sleeve-side first cooling stage 148, it is possible to adjust the pressing contact pressure between the cold head-side second cooling stage 232 and the sleeve-side second cooling stage 248.

Hitherto, the embodiments of the invention have been described, based on the application examples. The following will be understood by those skilled in the art. The present invention is not limited to the above-described embodiment, and various design changes can be made. Various modification examples can be adopted, and the modification examples also fall within the scope of the invention.

The present invention can be used in a field of a mounting structure and a mounting method of a cryocooler to be mounted on a vacuum vessel.

It should be understood that the invention is not limited to the above-described embodiment, but may be modified into various forms on the basis of the spirit of the invention. Additionally, the modifications are included in the scope of the invention.

What is claimed is:

1. A mounting structure for mounting a cold head of a cryocooler on a vacuum vessel, where the cold head has a cold head-side cooling stage and a cold head-side flange, the mounting structure comprising:

a cold head accommodation sleeve that is installed in the vacuum vessel so as to form an airtight region, isolated from an ambient environment, between the cold head and the cold head accommodation sleeve, and which includes a sleeve-side cooling stage which comes into thermal contact with the cold head-side cooling stage by coming into physical contact with the cold head-side cooling stage, and a sleeve-side flange to be coupled to the cold head-side flange, an inter-flange distance adjustment mechanism configured to adjust a distance between the sleeve-side flange and the cold head-side flange so that the cold head-side cooling stage and the sleeve-side cooling stage are physically brought into contact with each other or brought into a contactless state therebetween, while maintaining isolation of the airtight region from the ambient environment, and a flange fastening mechanism configured to fasten the cold head-side flange to the sleeve-side flange so that the cold head-side cooling stage is pressed against the sleeve-side cooling stage with a pressing contact pressure designated to bring the cold head-side cooling stage and the sleeve-side cooling stage into thermal contact with each other under thermal resistance equal to or smaller than a threshold.

2. The mounting structure according to claim 1, further comprising:

a cold head-side temperature sensor that measures a temperature of the cold head-side cooling stage; and a sleeve-side temperature sensor that measures a temperature of the sleeve-side cooling stage, wherein the cold head-side flange is fastened to the sleeve-side flange by the flange fastening mechanism so that a temperature difference between a measurement temperature of the cold head-side cooling stage and a measurement temperature of the sleeve-side cooling stage falls within a predetermined temperature difference corresponding to the threshold.

3. The mounting structure according to claim 1, wherein the inter-flange distance adjustment mechanism includes a lift-up bolt hole formed in the cold head-side flange and a lift-up bolt screwed into the lift-up bolt hole, and wherein the inter-flange distance adjustment mechanism is configured to raise and lower the cold head-side flange to and from the sleeve-side flange by rotating the lift-up bolt in a state where the lift-up bolt butts against the sleeve-side flange.

4. The mounting structure according to claim 1, wherein the cold head-side cooling stage includes a cold head-side heat transfer block formed of a heat conductive material, wherein the sleeve-side cooling stage includes a sleeve-side heat transfer block formed of a heat conductive material, and wherein the cold head-side cooling stage and the sleeve-side cooling stage are brought into thermal contact with each other by direct physical contact between the cold head-side heat transfer block and the sleeve-side heat transfer block.

5. The mounting structure according to claim 1, wherein the cold head is a two-stage cold head, and the cold head accommodation sleeve is a two-stage sleeve, and wherein the flange fastening mechanism is configured to fasten the cold head-side flange to the sleeve-side flange so that a cold head-side second cooling stage is pressed against a sleeve-side second cooling stage with the pressing contact pressure designated to bring the cold head-side second cooling stage and the sleeve-side second cooling stage into thermal contact with each other under the thermal resistance equal to or smaller than the threshold.

6. The mounting structure according to claim 5, wherein a cold head-side first cooling stage and a sleeve-side first cooling stage come into thermal contact with each other via a heat transfer spring mechanism.

7. A mounting method of mounting a cold head of a cryocooler on a vacuum vessel via a cold head accommodation sleeve, where the cold head has a cold head-side cooling stage and a cold head-side flange, and the cold head accommodation sleeve has a sleeve-side cooling stage which comes into thermal contact with the cold head-side cooling stage by coming into physical contact with the cold head-side cooling stage, and a sleeve-side flange to be coupled to the cold head-side flange, and the cold head accommodation sleeve is installed in the vacuum vessel so as to form an airtight region isolated from an ambient environment between the cold head and the cold head accommodation sleeve, the method comprising:

adjusting a distance between the sleeve-side flange and the cold head-side flange so that the cold head-side cooling stage and the sleeve-side cooling stage are physically brought into contact with each other, while isolation of the airtight region from the ambient environment is maintained, and fastening the cold head-side flange to the sleeve-side flange so that the cold head-side cooling stage is pressed against the sleeve-side cooling stage with a pressing contact pressure designated to bring the cold head-side cooling stage and the sleeve-side cooling stage into thermal contact with each other under thermal resistance equal to or smaller than a threshold.

8. The mounting method according to claim 7, further comprising:

measuring a temperature of the cold head-side cooling stage; and measuring a temperature of the sleeve-side cooling stage, wherein the cold head-side flange is fastened to the sleeve-side flange by the flange fastening mechanism so that a temperature difference between the measured temperature of the cold head-side cooling stage and the measured temperature of the sleeve-side cooling stage falls within a predetermined temperature difference corresponding to the threshold.

* * * * *